US011504967B2

(12) United States Patent
Marubayashi et al.

(10) Patent No.: US 11,504,967 B2
(45) Date of Patent: Nov. 22, 2022

(54) METHOD OF MANUFACTURING NOZZLE PLATE, AND INKJET HEAD

(71) Applicant: KONICA MINOLTA, INC., Tokyo (JP)

(72) Inventors: Jun Marubayashi, Kodaira (JP); Akihisa Shimomura, Atsugi (JP); Yusuke Hayashi, Hino (JP); Tadashi Hirano, Hino (JP); Shingo Uraki, Akishima (JP); Yohei Sato, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 17/049,186

(22) PCT Filed: Apr. 20, 2018

(86) PCT No.: PCT/JP2018/016243
§ 371 (c)(1),
(2) Date: Oct. 20, 2020

(87) PCT Pub. No.: WO2019/202723
PCT Pub. Date: Oct. 24, 2019

(65) Prior Publication Data
US 2021/0245505 A1 Aug. 12, 2021

(51) Int. Cl.
*B41J 2/14* (2006.01)
*B41J 2/16* (2006.01)

(52) U.S. Cl.
CPC ..... *B41J 2/1433* (2013.01); *B41J 2/162* (2013.01); *B41J 2/1634* (2013.01)

(58) Field of Classification Search
CPC ..... B41J 2/1433; B41J 2/162; B41J 2/1634
See application file for complete search history.

(56) References Cited

U.S. PATENT DOCUMENTS

2006/0012633 A1* 1/2006 Yokouchi ..... B41J 2/14233 347/44
2007/0064049 A1* 3/2007 Harajiri ..... B41J 2/1623 347/47
2017/0313078 A1* 11/2017 Ueki ..... B41J 2/1632

FOREIGN PATENT DOCUMENTS

JP S63081050 A 4/1988
JP 2003154652 A 5/2003
JP 2004009660 A 1/2004
JP 2004255696 A 9/2004
JP 2004255702 A 9/2004
(Continued)

OTHER PUBLICATIONS

PCT International Preliminary Report on Patentability with Written Opinion of the International Searching Authority for International Application No. PCT/JP2018/016243, dated Oct. 20, 2020.
(Continued)

*Primary Examiner* — Jason S Uhlenhake
(74) *Attorney, Agent, or Firm* — Cantor Colburn LLP

(57) ABSTRACT

Disclosed is a method of manufacturing, a metal nozzle plate, in which is formed a nozzle for discharging a liquid and that is to be bonded with adhesive to a head chip provided with an actuator for discharging the liquid, the method including: forming the nozzle in a metal plate-like member; forming a groove in the metal plate-like member; and performing exterior processing with respect to the nozzle plate.

21 Claims, 29 Drawing Sheets

(56) References Cited

FOREIGN PATENT DOCUMENTS

| | | | | | |
|---|---|---|---|---|---|
| JP | 2005022180 | A | | 1/2005 | |
| JP | 2006027122 | A | | 2/2006 | |
| JP | 2007137039 | A | | 6/2007 | |
| JP | 2015112848 | A | | 6/2015 | |
| JP | 2015166161 | A | | 9/2015 | |
| JP | 2015202671 | A | | 11/2015 | |
| JP | 2015231726 | A | | 12/2015 | |
| JP | 2017074723 | A | | 4/2017 | |
| JP | 2017074723 | A | * | 4/2017 | |
| WO | 2015080265 | A1 | | 6/2015 | |
| WO | 2015087155 | A | | 6/2015 | |
| WO | WO-2015080265 | A1 | * | 6/2015 | ..... B41J 2/14209 |

OTHER PUBLICATIONS

JPO Notice of Reasons for Refusal for corresponding JP Patent Application No. 2020-514881; dated Oct. 19, 2021.
CNIPA First Office Action for corresponding CN Application No. 201880092534.8; dated Apr. 2, 2021.
International Search Report for International Application No. PCT/2018/016243; dated Jun. 5, 2018.
CNIPA The Second Office Action for corresponding CN Application No. 201880092534.8; dated Jan. 4, 2022.

* cited by examiner

| RATIO OF STAINLESS STEEL THICKNESS / NOZZLE DIAMETER | (RATIO OF STAINLESS STEEL THICKNESS / NOZZLE DIAMETER) | MENISCUS RETREAT POSITION | EASE OF ASSEMBLY | OVERALL |
|---|---|---|---|---|
| 20 | 0.83 | △ (NOT OK) | N/A | △ (NOT OK) |
| 30 | 1.25 | ○ (OK) | ○ (OK) | ○ (OK) |
| 40 | 1.67 | ○ (OK) | ○ (OK) | ○ (OK) |
| 50 | 2.08 | ○ (OK) | ○ (OK) | ○ (OK) |
| 60 | 2.50 | ○ (OK) | △ (NOT OK) | △ (NOT OK) |

METHOD OF MANUFACTURING NOZZLE PLATE, AND INKJET HEAD

CROSS REFERENCE TO RELATED APPLICATIONS

This is the U.S. national stage of application No. PCT/JP2018/016243, filed on Apr. 20, 2018 to which priority is claimed and the disclosure of which is incorporated herein by reference.

TECHNICAL FIELD

The present invention relates to a method of manufacturing a nozzle plate, and to an inkjet head.

BACKGROUND ART

An inkjet head that discharges a liquid has a head chip in which a plurality of pressure chambers are formed and a nozzle plate in which nozzles from which the liquid is discharged are formed. Adhesive is used to bond the nozzle plate to an end surface of the head chip.

Patent Document 1 recites having a material for forming this nozzle plate be a metal plate, and forming nozzles by press working and polishing.

Patent Document 2 recites having a material for forming a nozzle plate be silicon, and forming nozzles by photolithography.

Patent Document 3 recites having a material for forming a nozzle plate be polyimide resin, and forming nozzles by laser machining or etching. Grooves for preventing adhesive from blocking nozzles when adhering the nozzle plate to a head chip are also formed in this nozzle plate.

CITATION LIST

Patent Literature

Patent Document 1: JP 2007-137039A
Patent Document 2: JP 2003-154652A
Patent Document 3: JP 2015-112848A

SUMMARY

Technical Problem

However, the nozzle plates of Patent Document 1 and 2 provide no countermeasures for adhesive when adhering the nozzle plates to a head chip, and there is the risk that discharge failure will occur due to the adhesive.

The nozzle plate of Patent Document 2 is formed from silicon, and this is unsuitable for an inkjet head in terms of chemical resistance, in particular because silicon is vulnerable to alkalinity.

The nozzle plate of Patent Document 3 comprises a polyimide resin, and has the problem of being inferior in strength and durability.

The purpose of the invention is to provide a method of manufacturing a nozzle plate having excellent durability and having good discharge characteristics, and an inkjet head.

Solution to Problem

The invention recited in claim 1 is: a method of manufacturing a metal nozzle plate, in which is formed a nozzle for discharging a liquid and that is to be bonded with adhesive to a head chip provided with an actuator for discharging the liquid, the method comprising:

forming the nozzle in a metal plate-like member;

forming a groove in the metal plate-like member; and performing exterior processing with respect to the nozzle plate.

The invention recited in claim 2 is: the method according to claim 1, wherein in the forming of the nozzle, one or a plurality of nozzle row in which a plurality of the nozzle are lined up in a straight line in a certain direction and at a certain interval is formed, and in the forming of the groove, the groove is formed parallel to the certain direction.

The invention recited in claim 3 is: the method according to claim 2, wherein in the forming of the groove, the groove is formed by a plurality of small grooves lined up on the same straight line parallel to the certain direction, and an interval of a gap region between adjacent small grooves is smaller than an interval of a gap region between adjacent nozzles.

The invention recited in claim 4 is: the method according to claim 3, wherein in the forming of the groove, each of the small grooves is formed in relation to the certain direction such that the gap region between adjacent small grooves does not overlap any nozzle of a nozzle row adjacent to the groove.

The invention recited in claim 5 is: the method according to any one of claims 2 to 4, wherein in the forming of the groove, the groove is formed to be longer than the nozzle row and so that the nozzle row is within the groove in the certain direction.

The invention recited in claim 6 is: the method according to any one of claims 2 to 5, wherein in the forming of the groove, the groove is formed at positions on both sides of the nozzle row to sandwich the nozzle row.

The invention recited in claim 7 is: the method according to any one of claims 1 to 6, wherein the groove is formed by wet etching.

The invention recited in claim 8 is: the method according to any one of claims 1 to 7, wherein in the exterior processing, a division that leaves a bridge is formed in the metal plate-like member along the exterior of the nozzle plate, and the method further comprising:

forming a water repellent film on the metal plate-like member after the exterior processing; and cutting the bridge to separate the nozzle plate after the water repellent film is formed.

The invention recited in claim 9 is: the method according to any one of claims 1 to 7, wherein in the exterior processing, the nozzle plate is separated from the metal plate-like member by dividing along the exterior of the nozzle plate, and the method further comprising:

forming a water repellent film on the metal plate-like member after the groove is formed and before the exterior processing.

The invention recited in claim 10 is: the method according to any one of claims 1 to 9, wherein, in the exterior processing, wet etching is performed on the metal plate-like member along the exterior of the nozzle plate, from a surface in which the groove was formed.

The invention recited in claim 11 is: the method according to any one of claims 1 to 10, further comprising polishing a surface in which the groove is to be formed before the groove is formed.

The invention recited in claim 12 is: the method according to any one of claims 1 to 11, wherein in the forming of the nozzle, the nozzle is formed by press working and polishing, or by laser machining.

The invention recited in claim 13 is: an inkjet head, comprising:

a head chip provided with an actuator for discharging a liquid; and a metal nozzle plate that is bonded with adhesive to the head chip, a nozzle for discharging the liquid being formed in the nozzle plate, wherein one or a plurality of nozzle row in which a plurality of the nozzle are lined up in a straight line in a certain direction and at a certain interval is formed in the nozzle plate, a groove is formed parallel to the certain direction on a first surface of the nozzle plate, the first surface facing the head chip, and a water repellent film is coated on a second surface of the nozzle plate, the second surface being on an opposite side from the head chip.

The invention recited in claim 14 is: the inkjet head according to claim 13, wherein the groove comprises a plurality of small grooves lined up on the same straight line parallel to the certain direction, and the groove is formed so that an interval of a gap region between adjacent small grooves is smaller than an interval of a gap region between adjacent nozzles.

The invention recited in claim 15 is: the inkjet head according to claim 14, wherein each of the small grooves is formed in relation to the certain direction such that the gap region between adjacent small grooves does not overlap any nozzle of a nozzle row adjacent to the groove.

The invention recited in claim 16 is: the inkjet head according to any one of claims 13 to 15, wherein the groove is formed to be longer than the nozzle row and so that the nozzle row is within the groove in the certain direction.

The invention recited in claim 17 is: the inkjet head according to any one of claims 13 to 16, wherein the groove is formed on both sides of the nozzle row to sandwich the nozzle row.

The invention recited in claim 18 is: the inkjet head according to any one of claims 13 to 17, wherein some or all of a perimeter end surface formed at a perimeter of the nozzle plate is such that an edge of the perimeter end surface on a side of the first surface is at an obtuse angle with respect to the first surface.

The invention recited in claim 19 is: the inkjet head according to any one of claims 13 to 18, wherein the nozzle plate is made of stainless steel, and the thickness of the nozzle plate is from 30 μm to 50 μm.

The invention recited in claim 20 is: the inkjet head according to claim 19, wherein a depth of the groove is from 5 μm to 20 μm.

Advantageous Effects of Invention

With the above configuration, the present invention can provide a method of manufacturing a nozzle plate having excellent durability and having good discharge characteristics, and an inkjet head.

DESCRIPTION OF EMBODIMENTS

Overview of Embodiments of the Invention

Figure 1:
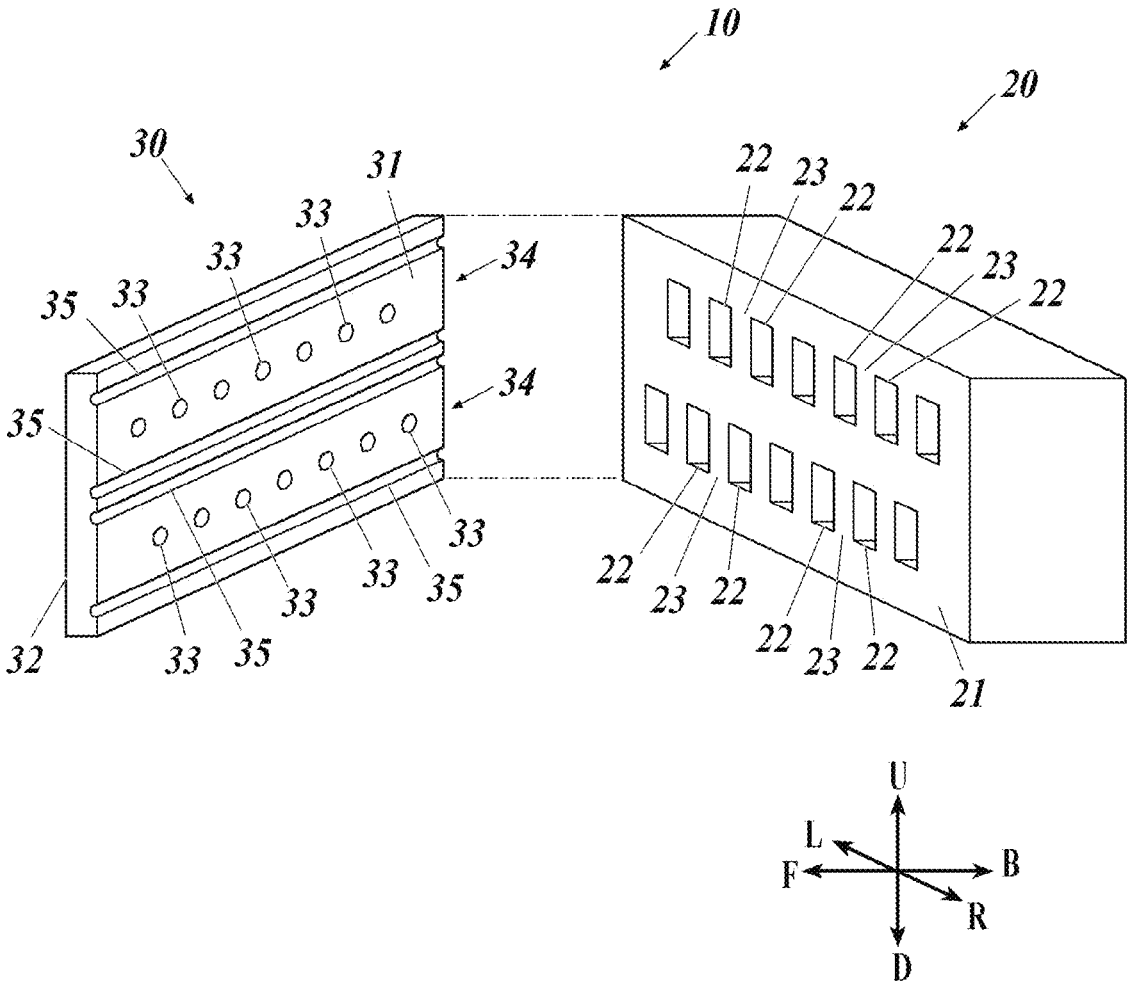
FIG. 1 is a perspective view of an inkjet head that are an embodiment of the invention, in which a nozzle plate and a head chip are separated from each other.
Figure 2:
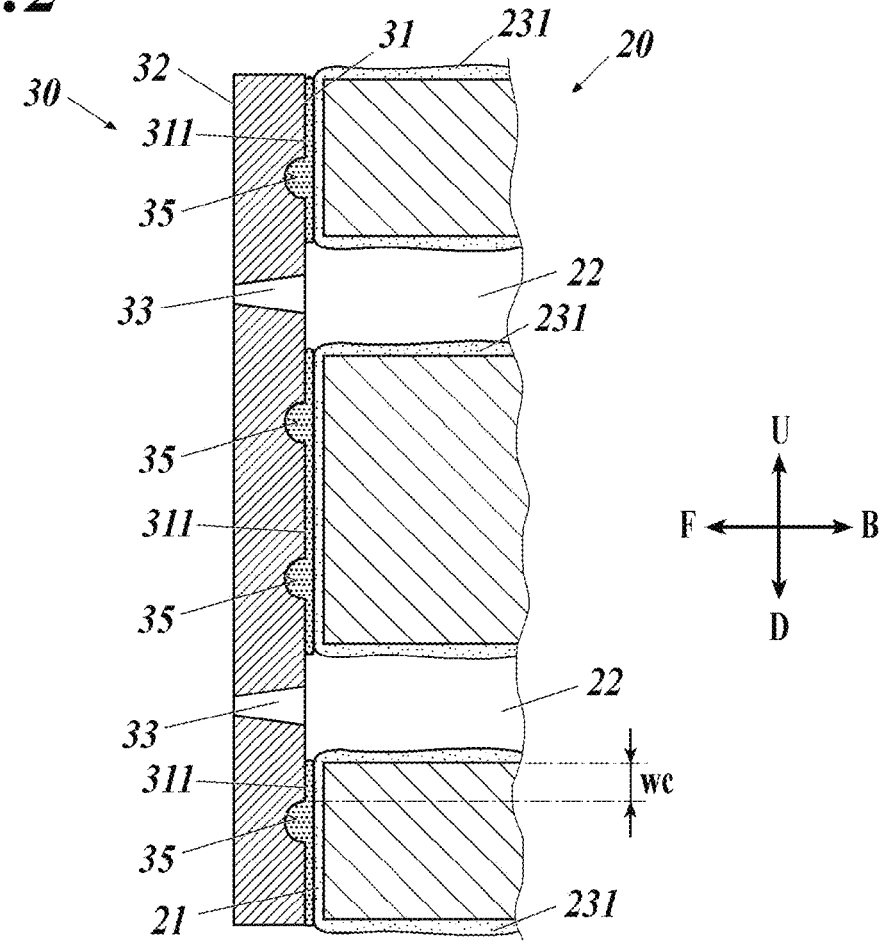
FIG. 2 is a cross-section view taken in the forward/backward and up/down directions of portions of the head chip and the nozzle plate that are bonded together.

An inkjet head 10 of the present invention is described below with reference to the drawings. The inkjet head 10 is provided with a head chip 20 and a nozzle plate 30. FIG. 1 illustrates a perspective view in which the head chip 20 and the nozzle plate 30 are separated. FIG. 2 illustrates a cross-section view taken in the forward/backward and up/down directions of portions of the head chip 20 and the nozzle plate 30 that are bonded together.

In all drawings for the present embodiment, the numbers of nozzles or channels aligned in a row are illustrated fewer than in practice.

Head Chip

The head chip 20 is a block that comprises a piezoelectric material in a rectangular parallelepiped shape. The nozzle plate 30 is bonded to a discharge side end surface of the head chip 20. The discharge side end surface of the head chip 20 is referred to as an adhesion surface 21. The adhesion surface 21 is a rectangular shape, and in the following description, a direction following a long side of the adhesion surface 21 is referred to as a left/right direction, a direction following a short side of the adhesion surface 21 is referred to as an up/down direction, and a direction perpendicular to the adhesion surface is referred to as a forward/backward direction. In FIG. 1, U indicates up, D indicates down, L indicates left, R indicates right, F indicates forward, and B indicates backward.

In the head chip 20, a plurality of channels 22 which are pressure chambers are formed following the forward/backward direction. Seen from in front, each of this plurality of channels 22 are formed in alignment with a certain interval therebetween along straight lines in two rows up and down that are parallel to the left/right direction. The interval at the center of the holes of the channels 22 aligned in the left/right direction matches the pitch (the interval between hole centers) of a plurality of nozzles 33 of the nozzle plate 30, which are described below. Channels 22 of the upper row are offset in the left/right direction by a distance of half the nozzle pitch (in FIG. 1, illustration is made in a state where arrangements in the left/right direction of the upper row of channels 22 and the lower row of channels 22 match for simplification).

A cross-sectional shape of each of the channels 22 as seen from in front is a rectangular shape that is longer up and down. An up/down opening width of a channel 22 is 150 to 450 μm, and a distance between a top end of a channel 22 of the lower row to a bottom end of a channel 22 of the upper row is 400 to 1500 μm.

As illustrated in FIG. 1, each channel 22 opens on the side of the adhesion surface 21 of the head chip 20, and individually communicates with a corresponding nozzle 33 of the nozzle plate 30. Each channel 22 also communicates with an ink manifold (not illustrated) on the side of a rear end surface of the head chip 20, and is supplied with ink.

Partitions 23 between channels 22 adjacent in the left/right direction are provided with an electrode on an inner surface of a channel 22, and by applying a drive voltage to the electrode of a corresponding partition 23, a piezoelectric effect occurs for the partition 23 which comprises a piezoelectric material, and it is possible to cause ink inside an adjacent channel 22 to be discharged. In other words, the electrode and the piezoelectric material that makes up the partition 23 function as an actuator for discharging liquid.

A resin coating 231 for protecting the electrode provided on the partition 23 from ink is formed on the head chip 20.

Nozzle Plate

Figure 3:
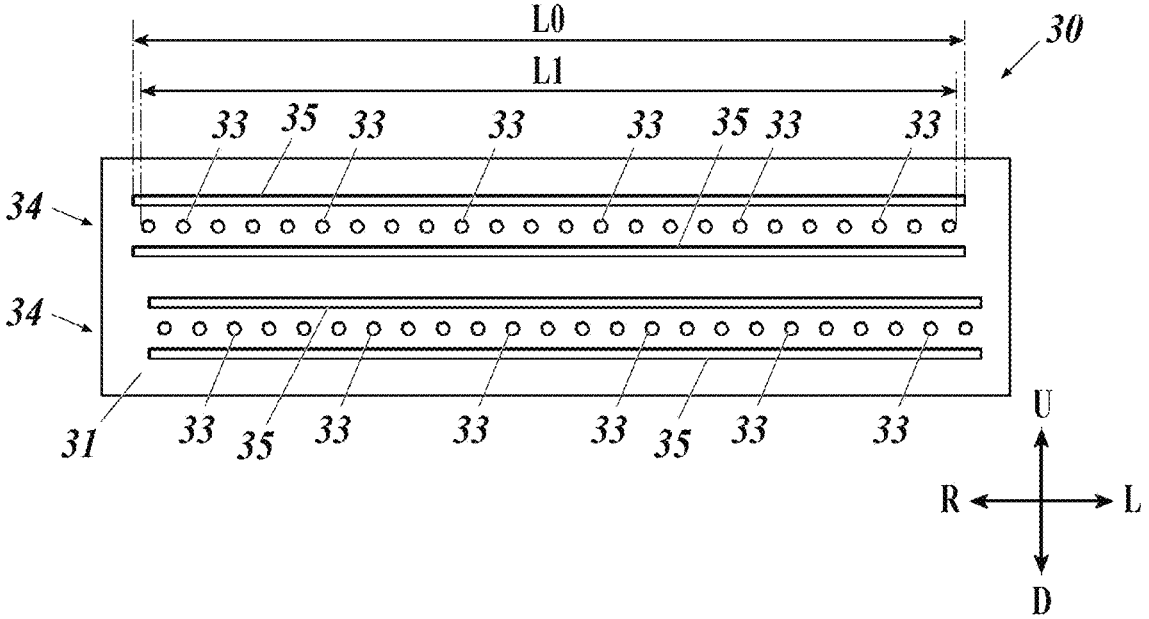
FIG. 3 is a rear view of the nozzle plate.

FIG. 3 is a rear view of a nozzle plate. As illustrated in FIG. 1 to FIG. 3, the nozzle plate 30 comprises a rectangular metal plate, and is formed from a metal having excellent alkali resistance and chemical resistance, for example a metal excluding silicon, desirably nickel (including alloys), and more desirably stainless steel.

One flat surface of the nozzle plate 30 is an adhesion surface with respect to the head chip 20, and the other flat surface is an ink discharge surface. In the following description, the adhesion surface with respect to the nozzle plate 30 is referred to as a first surface 31, and the discharge surface is referred to as a second surface 32.

For the nozzle plate 30, a direction following a long side of the first surface 31 is referred to as a left/right direction, a direction following a short side of the first surface 31 is referred to as an up/down direction, and a direction perpendicular to the first surface 31 is referred to as a forward/backward direction. However, with respect to FIG. 1, because illustration is given with the nozzle plate 30 separated from the head chip 20 and having a tilted orientation, the reference symbols L, R, F, and B do not match the left, right, forward, and backward directions for the nozzle plate 30.

A plurality of nozzles 33 that penetrate along the forward/backward direction are formed in alignment in the nozzle plate 30 at a certain nozzle pitch along straight lines in two rows up and down that are parallel to the left/right direction. The two rows up and down that comprise the plurality of nozzles 33 that are parallel in the left/right direction are each referred to as a nozzle row 34.

The nozzle pitch of each of the nozzles 33 matches the pitch in the left/right direction of each channel of the head chip 20, and the up/down interval between the two nozzle rows 34 (the distance in the up/down direction from the center of a nozzle 33 of one nozzle row 34 to the center of a nozzle 33 of the other nozzle row 34) matches the interval (the interval in the up/down direction between the center of a channel 22 and the center of a channel 22) between a channel 22 of the upper row of channels 22 and the channel 22 of the lower row of channels 22.

The upper nozzle row 34 and the lower nozzle row 34 are offset in the left/right direction by a distance of half the nozzle pitch.

Accordingly, in a case where the first surface 31 of the nozzle plate 30 is bonded to the adhesion surface 21 of the head chip 20, it is possible to have an arrangement where individual nozzles 33 overlap the inside of the openings of individual channels 22 seen from the forward/backward direction, and it is possible to cause each channel 22 to individually communicate with a corresponding nozzle 33.

For each nozzle row 34, grooves 35 are formed in the first surface 31 of the nozzle plate 30, sandwiching the respective nozzle row 34 from above and below.

When the head chip 20 is bonded to the nozzle plate 30, in a case where adhesive sandwiched between the first surface 31 and the adhesion surface 21 expands along these surfaces 21 and 31, these grooves 35 function as catchment spaces that accept excess adhesive so that it does not get into the nozzles 33.

By providing a groove 35 respectively above and below each nozzle row 34, it is possible to accept adhesive from regions above and below the nozzle row 34, and inflow of adhesive into the nozzles 33 is suppressed.

Each groove 35 is formed so that its length L0 in the left/right direction is longer than a length L1 in the left/right direction of the nozzle row 34, and the nozzle row 34 is inside the groove 35 with respect to the left/right direction. In other words, the left edge of the nozzle row 34 is positioned rightward of the left edge of the groove 35, and the right edge of the nozzle row 34 is positioned leftward of the right edge of the groove 35.

By this, it is possible to accept adhesive from above and below the nozzle row 34 across the entire range of the left/right direction, and inflow of into the nozzles 33 is effectively suppressed.

Although each groove 35 does not reach the left and right edges of the nozzle plate 30 in FIG. 3, each groove 35 may be formed such that one or both edges of the groove 35 reaches the corresponding one of the left edge and right edge of the nozzle plate 30 as in FIG. 1.

In such a case, when the nozzle plate 30 is bonded to the head chip 20, because an edge of the groove 35 is open externally, it is possible to expel air inside the groove 35, and it will be easier for the adhesive to flow in.

A cross-sectional shape of each groove 35 has a narrower width towards a depth direction thereof, and, for example, is roughly semicircular as illustrated in FIG. 2. When the inside surface of the groove 35 has a shape that is inclined at an obtuse angle with respect to the first surface 31, it becomes easier to draw adhesive on the first surface 31 into the groove 35 along its inside surface, and this is more desirable.

It is also desirable from a relationship with respect to ink discharge performance for the thickness of the nozzle plate to be 30 to 50 μm. This point will be discussed later.

In contrast to this, it is desirable for the depth of the groove 35 in the forward/backward direction to be in a range of 5 to 20 μm. If the groove 35 is shallower than this range, there is a risk that the capacity for adhesive will be insufficient, and, if the groove 35 is deeper than this range, there is a risk that thickness at the bottom of the groove 35 will be too thin and the nozzle plate 30 will have insufficient strength.

It is also desirable for a distance we from the groove 35 to a channel 22 that communicates with a nozzle 33 of the nozzle row 34 (a distance from an edge of the groove 35 on the nozzle row 34 side to an edge of the channel 22 on the groove 35 side), as illustrated in FIG. 2, to be 50 μm or more. If the distance we is less than this, it will be less likely for flow of adhesive to occur due to capillary force, and there is a risk that a gap will arise between the nozzle plate 30 and the head chip 20.

Each groove 35 is arranged so as not to communicate with any channel 22 when the nozzle plate 30 is bonded to the head chip 20.

Method of Manufacturing Nozzle Plate

A method of manufacturing the nozzle plate 30 having the above configuration will be described with reference to FIG. 4A to FIG. 8.

A case of manufacturing three nozzle plates 30 from one plate-like member P made of stainless steel is given as an example here. The number of nozzle plates 30 manufactured from one plate-like member P is merely an example, and may be increased or decreased.

Figure 4A:
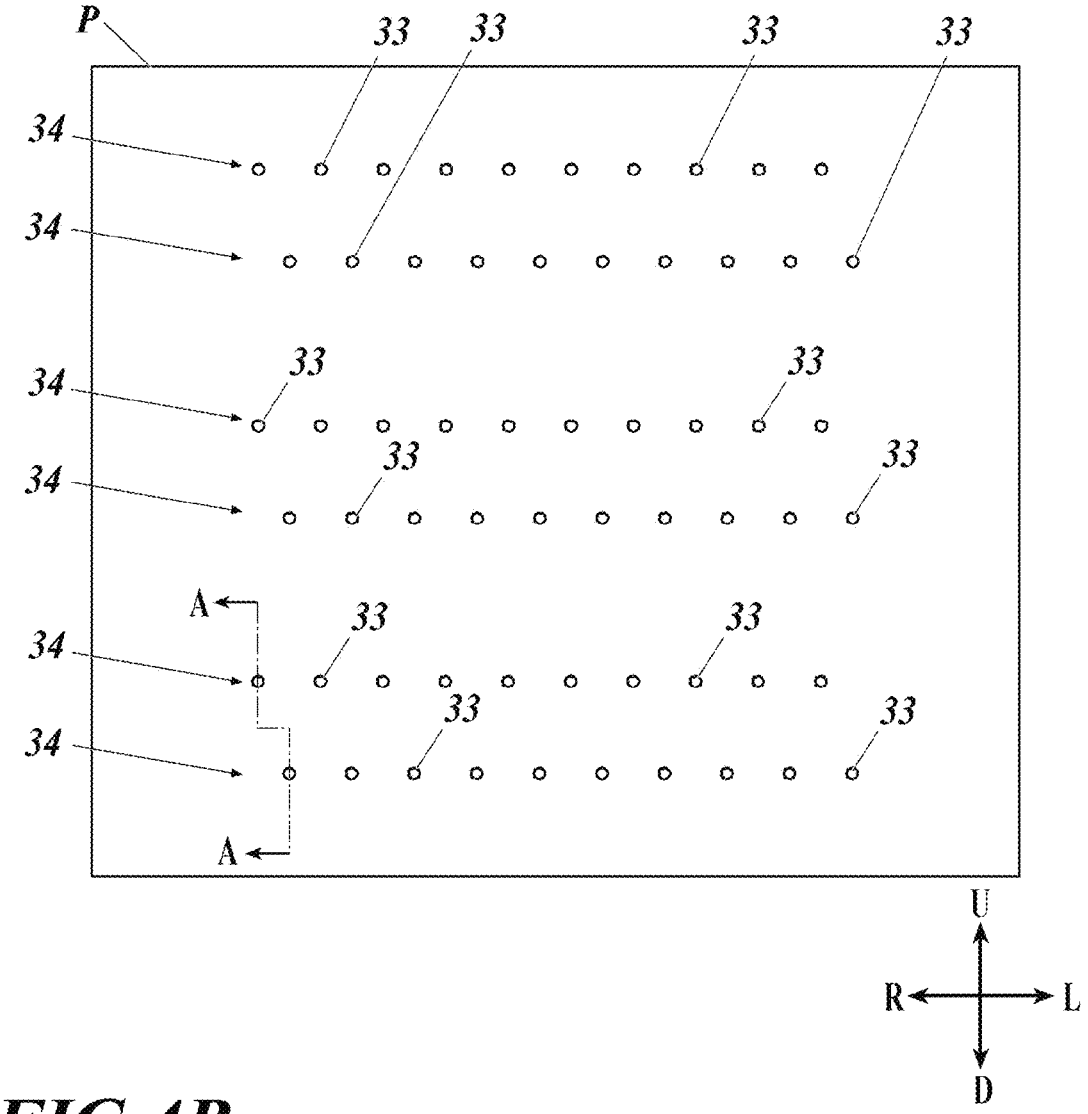
FIG. 4A is a plan view of a metal plate, illustrating a nozzle formation step in the manufacture of the nozzle plate.
Figure 4B:
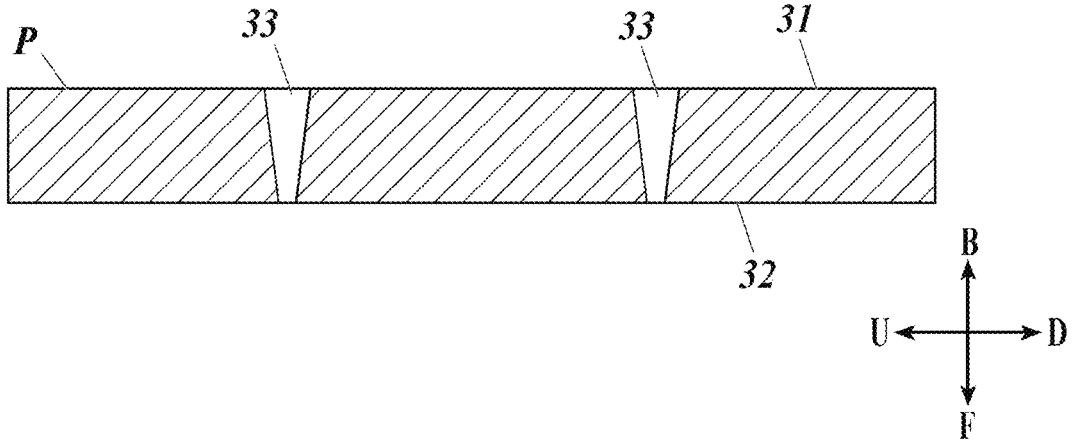
FIG. 4B is a cross-section view taken along an A-A line in FIG. 4A.

Firstly, as illustrated by FIG. 4A and FIG. 4B, a plurality of nozzles 33 are formed at a predetermined nozzle pitch so that nozzle rows 34 are formed following the left/right direction (nozzle formation step).

Each nozzle 33 is formed at a corresponding position described previously by laser machining or press working and polishing.

The surface of the plate-like member P which is to be the first surface 31 of a nozzle plate 30 is then polished (polishing step). This polishing is done for forming a good photoresist film, which is used for forming grooves 35 in the subsequent groove formation step by wet etching, on the surface that is to be the first surface 31.

Figure 5A:
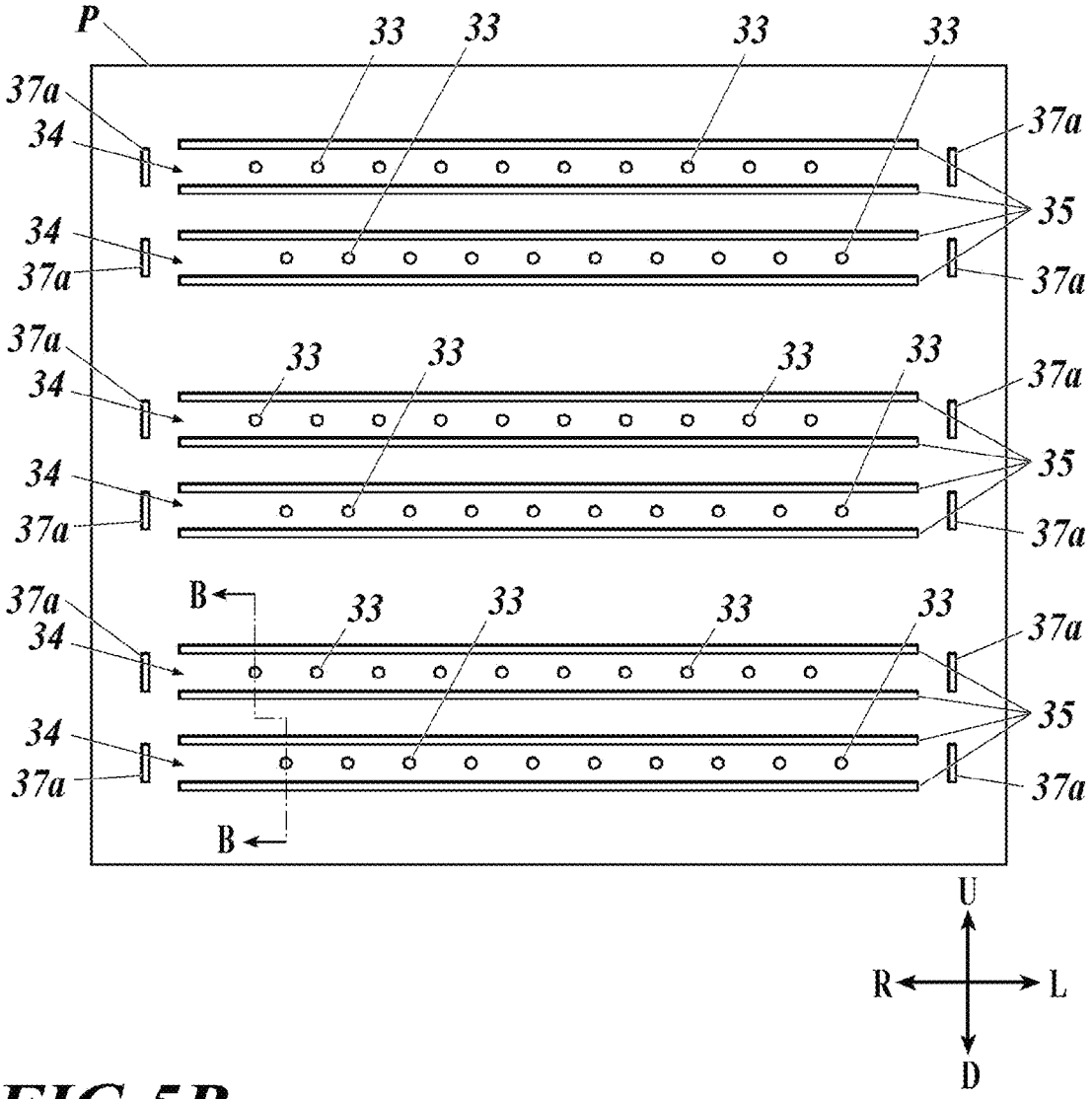
FIG. 5A is a plan view of the metal plate, illustrating a groove formation step in the manufacture of the nozzle plate.
Figure 5B:
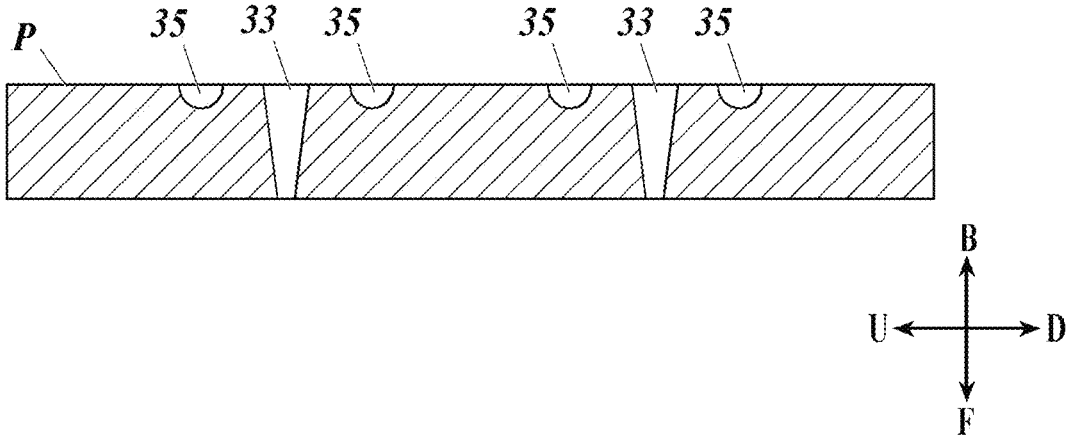
FIG. 5B is a cross-section view taken along a B-B line in FIG. 5A.

Next, as illustrated by FIG. 5A and FIG. 5B, two grooves 35 are formed at arrangements described previously following the left/right direction and sandwiching each nozzle row 34, on the surface of the plate-like member P that is to be the first surfaces 31 of the nozzle plates 30 (groove formation step).

Each groove 35 is formed by wet etching. In other words, a dry film resist is pasted onto the surface of the plate-like member P that is to be the first surfaces 31 of the nozzle plates 30, planned positions at which to form each groove 35 with respect to a corresponding nozzle row 34 are exposed through a photo mask, the dry film resist is removed from the planned positions at which to form each groove 35, and the plate-like member P is immersed in etching liquid. An amount of time of immersion in the etching liquid is adjusted so that the grooves 35 are formed with a target depth. Subsequently, the dry film resist is removed.

In this step, together with the grooves 35, grooves 37*a*, which are precursors for bridges 37 described below, are formed at planned positions at which the bridges 37 are formed. The bridges 37 are described below.

Figure 6A:
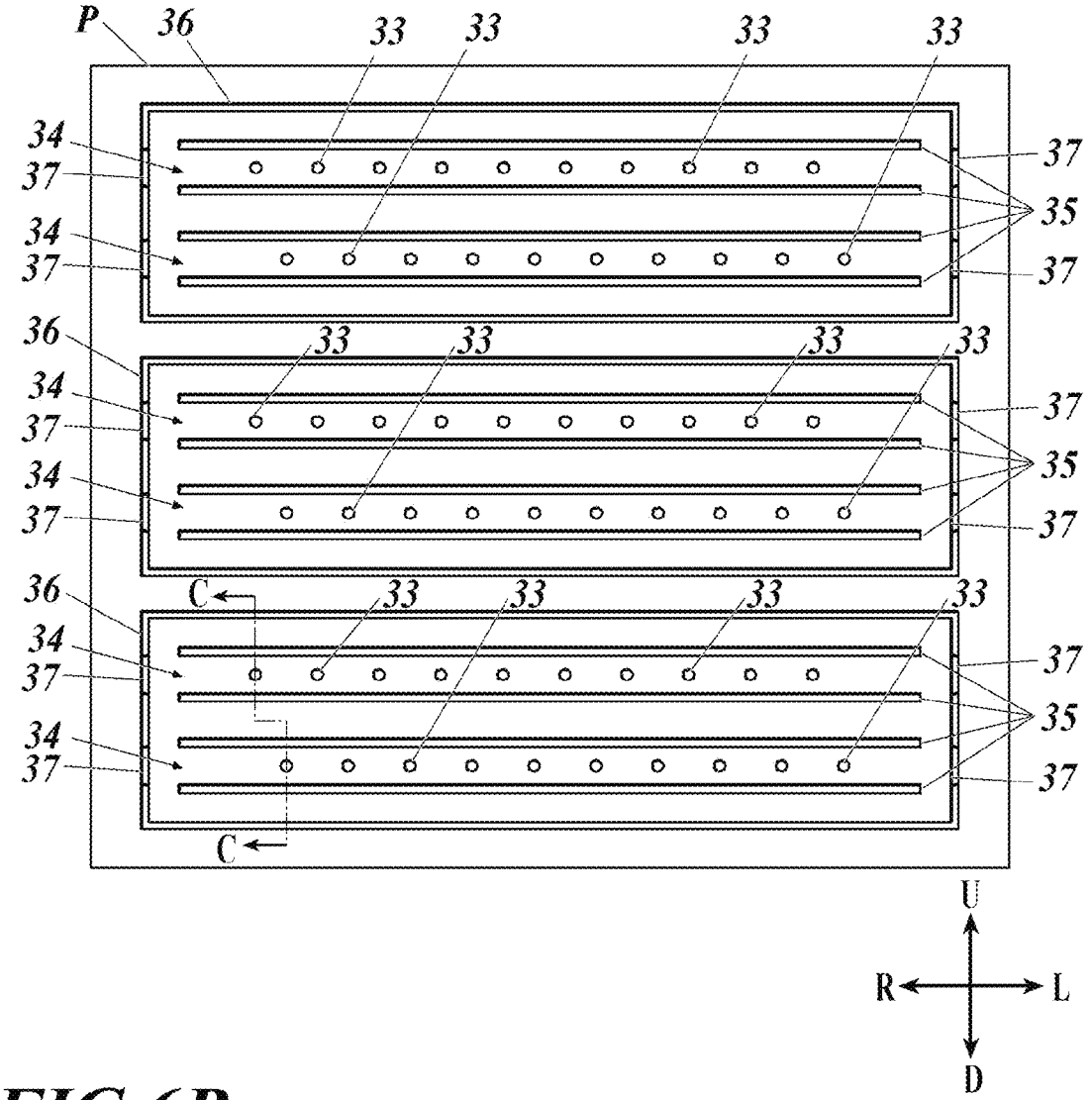
FIG. 6A is a plan view of the metal plate, illustrating a nozzle exterior processing step in the manufacture of the nozzle plate.
Figure 6B:
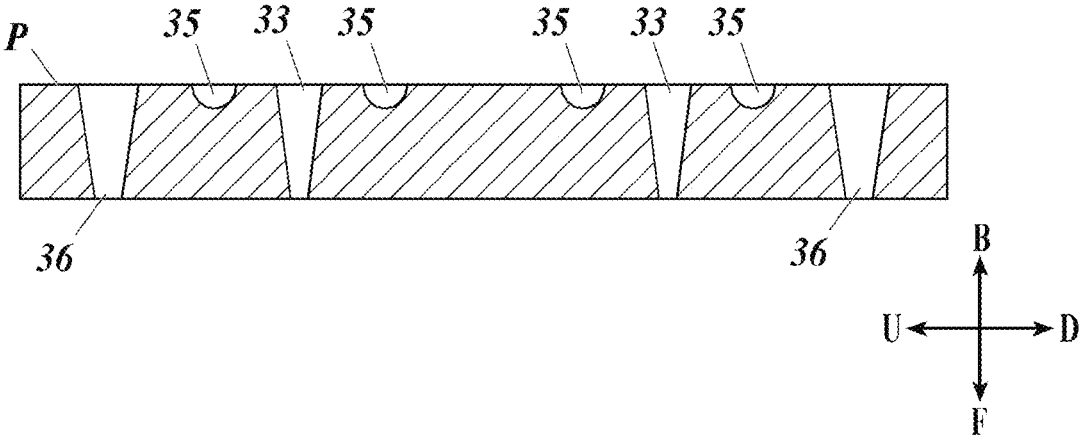
FIG. 6B is a cross-section view taken along a C-C line in FIG. 6A.

Next, as illustrated by FIG. 6A and FIG. 6B, divisions 36 that keep some bridges 37 are formed by wet etching the plate-like member P along the exterior of the nozzle plates 30 (exterior processing step). The divisions 36 can be formed by laser machining or press working, but it is desirable to form the divisions 36 by wet etching. This is separately described below.

The divisions 36 are slots that are penetratingly formed forwards and backwards along the exterior of the nozzle plates 30. Because the bridges 37, which are parts of the exterior of the nozzle plates 30, remain, a portion that is to be a nozzle plate 30 maintains a state of being held and not separating from the plate-like member P. In this way, by forming the divisions 36 while keeping the bridges 37, it is possible to finally separate the nozzle plates 30 from the plate-like member P by simply cutting only the bridges 37.

Figure 7A:
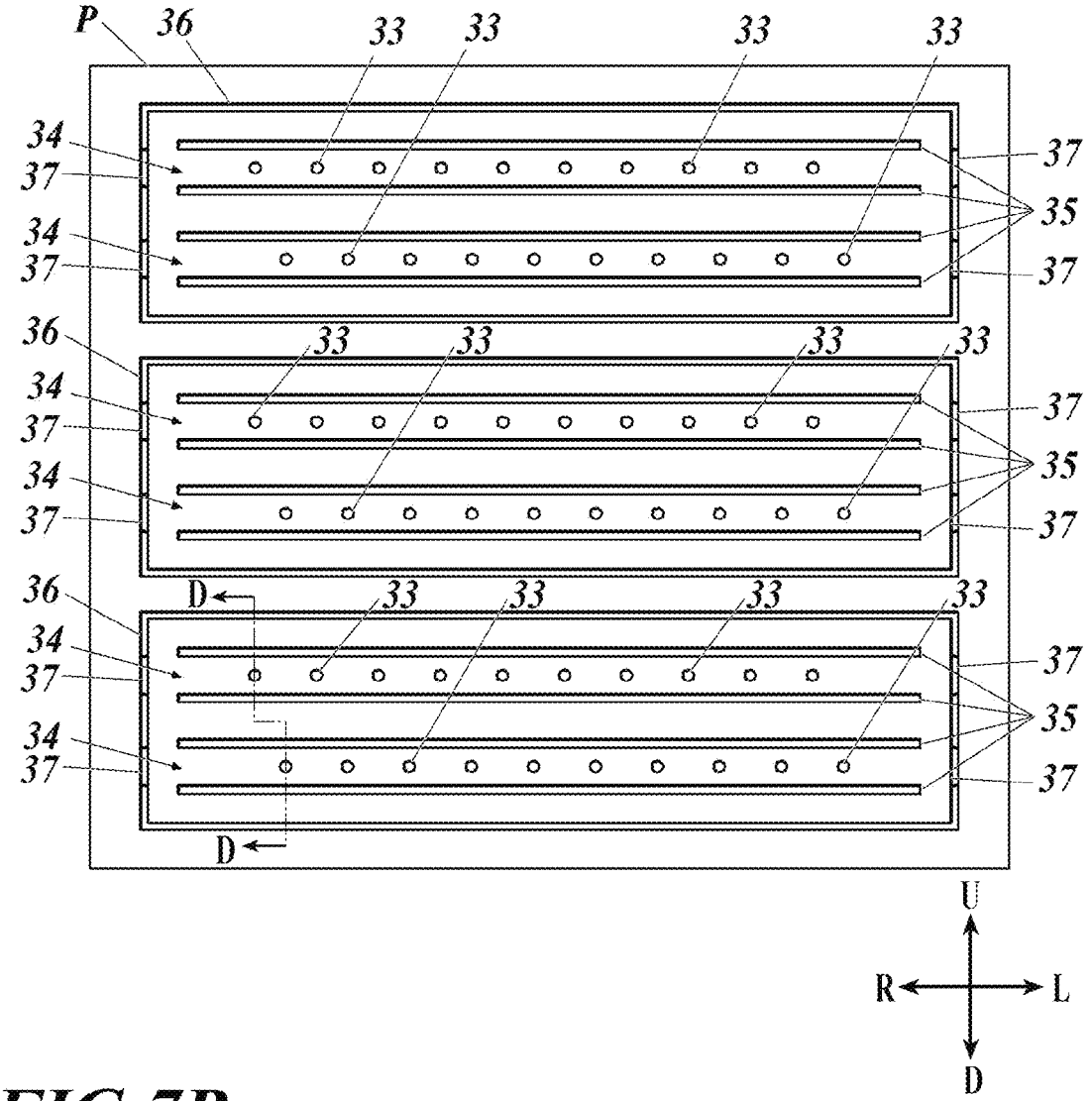
FIG. 7A is a plan view of the metal plate, illustrating a film formation step in the manufacture of the nozzle plate.
Figure 7B:
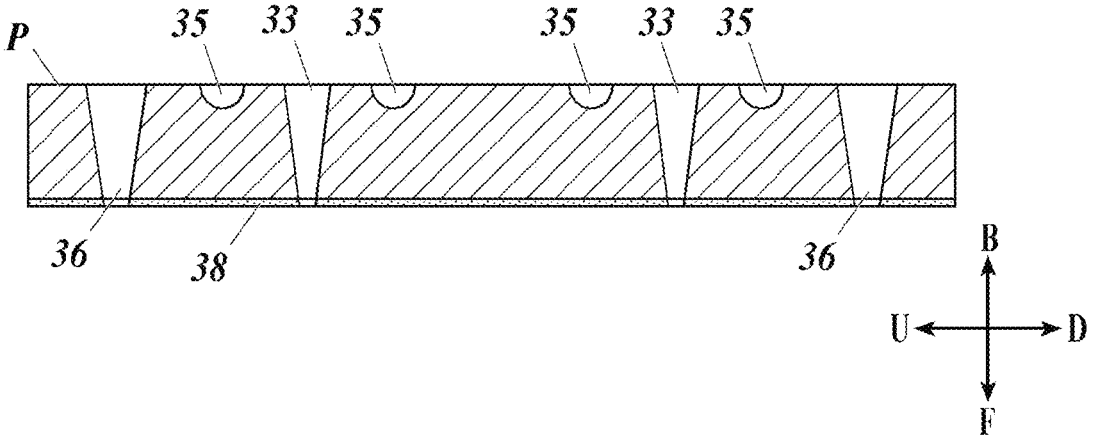
FIG. 7B is a cross-section view taken along a D-D line in FIG. 7A.

Next, as illustrated by FIG. 7A and FIG. 7B, a water repellent film 38 is formed on a surface of the plate-like member P that is to be the second surfaces 32 of the nozzle plates 30 (film formation step).

The water repellent film 38 is formed by applying a coating liquid that includes fluorine resin, drying the liquid, and heat-treating the liquid. It is possible to use a well-known coating method to apply the coating liquid, such as vapor deposition, spray coating, spin coating, or brush coating.

An underlayer may be formed before the water repellent film is formed. As the underlayer, a film that comprises one or a plurality of metal elements selected from tantalum, zirconium, hafnium, niobium, titanium, tungsten, cobalt, molybdenum, vanadium, lanthanum, manganese, chromium, yttrium, praseodymium, ruthenium, rhodium, rhenium, iridium, cerium, and aluminum, and comprises one or a plurality of elements selected from oxygen, nitrogen, and carbon may be formed. Alternatively, a film selected from silicon oxide, silicon oxycarbide, tantalum silicate, and silicon carbo-oxide may be formed.

By forming such an underlayer, it is possible to strengthen the bonds of the water repellent film, and improve its chemical resistance or scratch resistance.

Figure 8:
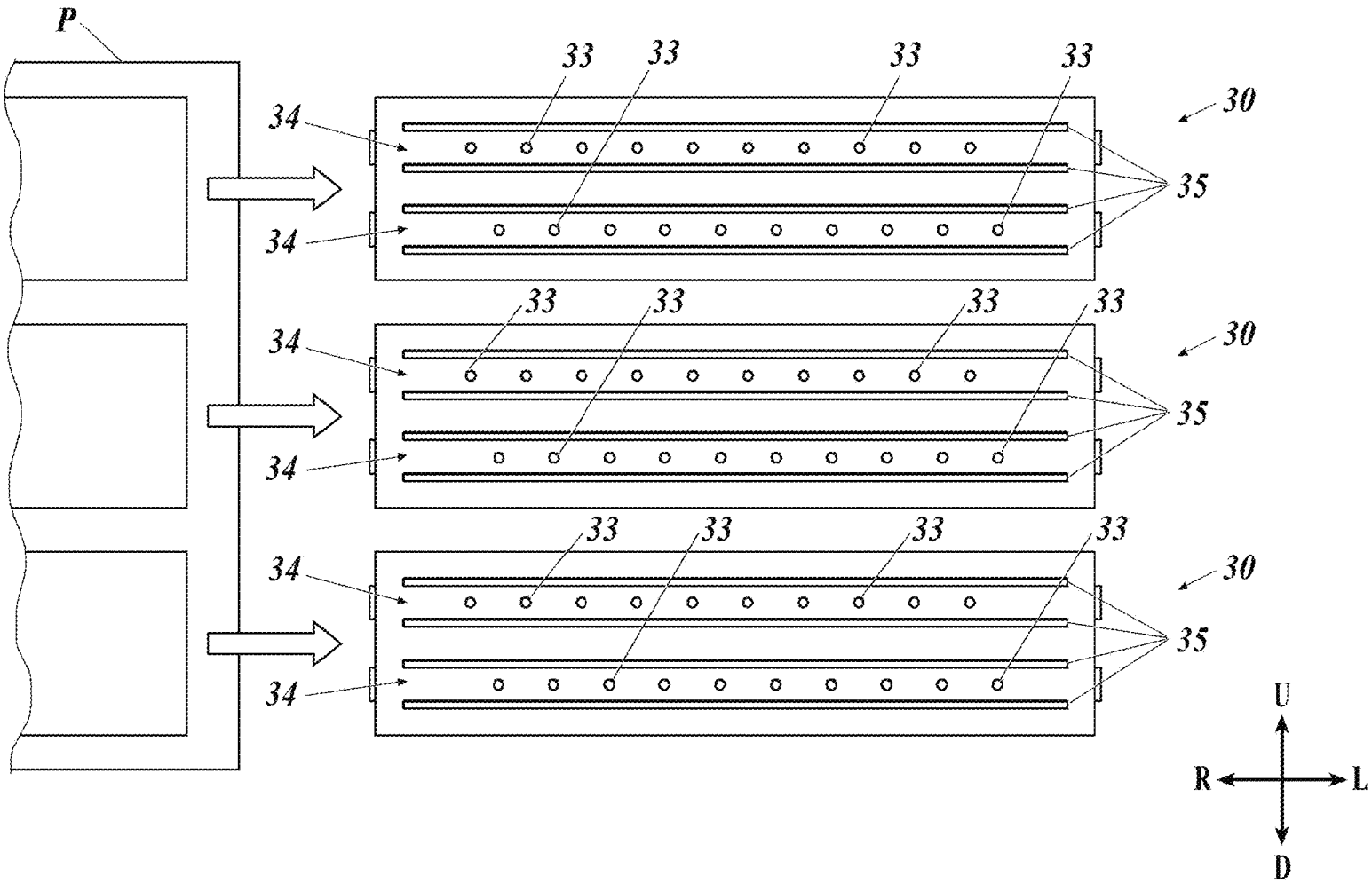
FIG. 8 is a plan view of the metal plate, illustrating a separation step in the manufacture of the nozzle plate.

Next, as illustrated by FIG. 8, the bridges 37 are cut, and the nozzle plates 30 are separated from the plate-like member P (separation step).

The bridges 37 may be cut by laser machining or press working, but may also be cut manually. In particular, because the bridges 37 are made thin by the formation of the grooves 37*a* in the groove formation step described above, it is possible to more easily cut the bridges 37.

By this, each individual nozzle plate 30 is formed.

Formation of Perimeter of Nozzle Plate by Wet Etching (1)

Description is given in detail regarding a plurality of methods for forming the perimeters of the nozzle plates 30 by forming the divisions 36 through wet etching as described above.

FIG. 9A to FIG. 9E illustrate in order a method of forming a division 36 from the side of the first surface 31 of a nozzle plate 30.

Figure 9A:
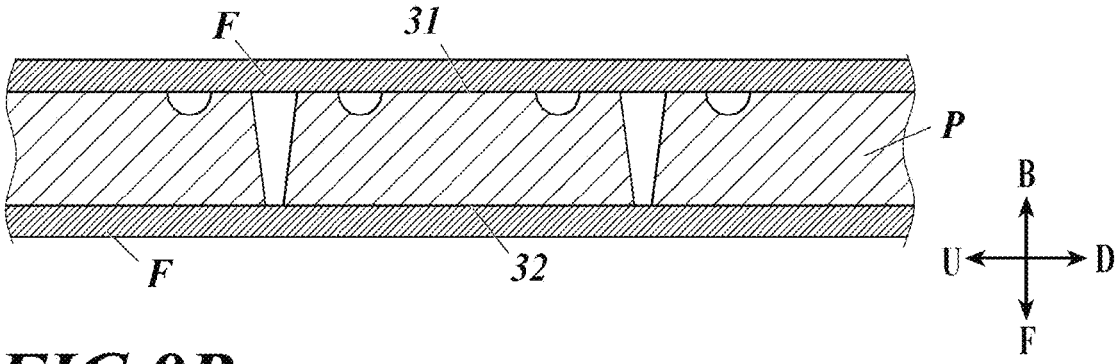
FIG. 9A is a step view, illustrating a method of forming (1) a perimeter of the nozzle plate in accordance with wet etching.
Figure 9B:
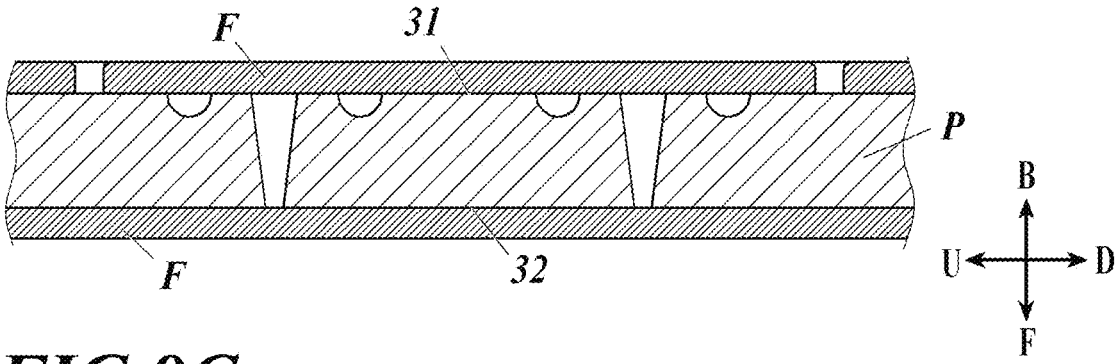
FIG. 9B is a step view that continues from FIG. 9A and illustrates the method of forming (1) the perimeter of the nozzle plate in accordance with wet etching.
Figure 9C:
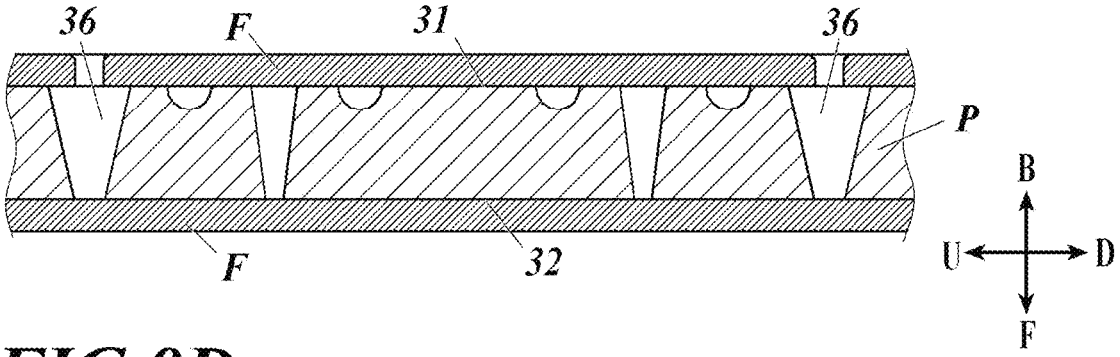
FIG. 9C is a step view that continues from FIG. 9B and illustrates the method of forming (1) the perimeter of the nozzle plate in accordance with wet etching.
Figure 9D:
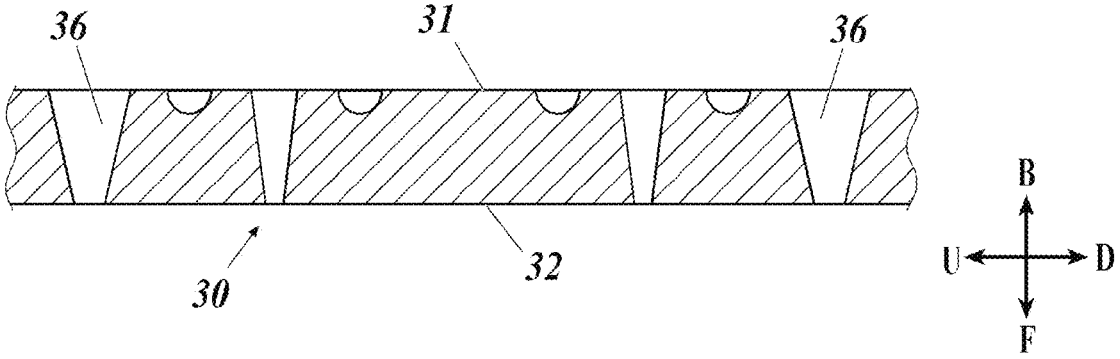
FIG. 9D is a step view that continues from FIG. 9C and illustrates the method of forming (1) the perimeter of the nozzle plate in accordance with wet etching.

That is, in the formation of the divisions 36, dry film resists are pasted on both surfaces of the plate-like member P (FIG. 9A), the planned positions at which to form each division 36 on the side of the first surface 31 are exposed through a photo mask and dry film resist is removed from the planned positions at which to form each division 36 (FIG. 9B), the divisions 36 are formed by immersion in etching liquid (FIG. 9C), and then the dry film resists are removed (FIG. 9D).

If the divisions 36 are formed from the side of the first surface 31 of the nozzle plate 30 by wet etching as described above, as illustrated in FIG. 9E, a perimeter end surface 39 of the nozzle plate 30 becomes a forward taper with respect to the head chip 20, and the perimeter end surface 39 is formed by an incline at an obtuse angle with respect to the first surface 31. As a result, when the nozzle plate 30 is bonded to the adhesion surface 21 of the head chip 20, if the adhesive of the adhesive layer 311 protrudes on the side of the perimeter end surface 39, the adhesive is kept between the adhesion surface 21 and the perimeter end surface 39, and it is possible to effectively suppress the adhesive from going around to the side of the second surface 32 where the water repellent film 38 is formed.

Figure 10:
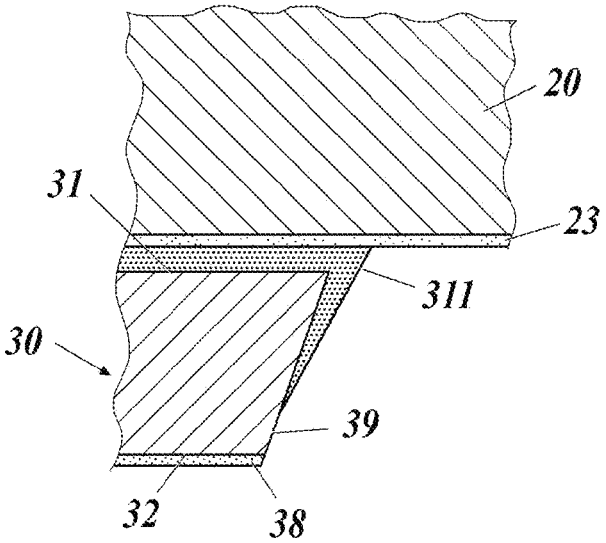
FIG. 10 is a cross-section view that illustrates an example in which the perimeter end surface of the nozzle plated is formed with an incline at an acute angle with respect to the first surface.

If, hypothetically, the divisions 36 are formed by wet etching from the side of the second surface 32 of the nozzle plate 30, as illustrated by FIG. 10, the perimeter end surface 39 of the nozzle plate 30 is formed by an incline at an acute angle with respect to the first surface 31, and it is easier for protruding adhesive to follow the perimeter end surface 39 and go around to the side of the second surface 32.

Formation of Perimeter of Nozzle Plate by Wet Etching (2)

FIG. 11A to FIG. 11E illustrate in order another example of a method of forming the divisions 36 of the nozzle plate 30.

Figure 11A:
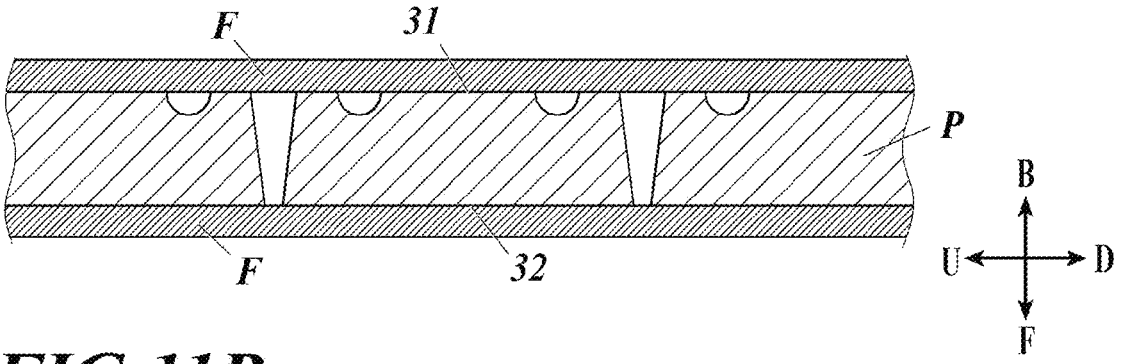
FIG. 11A is a step view, illustrating a method of forming (2) a perimeter of the nozzle plate in accordance with wet etching.
Figure 11B:
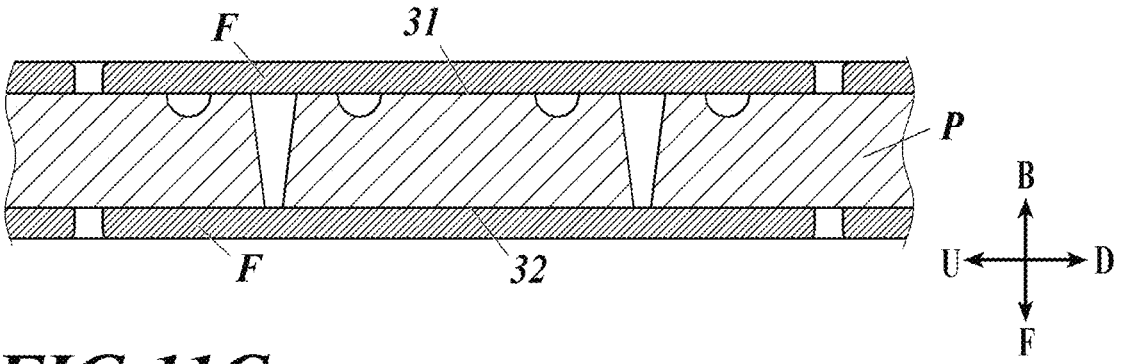
FIG. 11B is a step view that continues from FIG. 11A and illustrates the method of forming (2) the perimeter of the nozzle plate in accordance with wet etching.
Figure 11C:
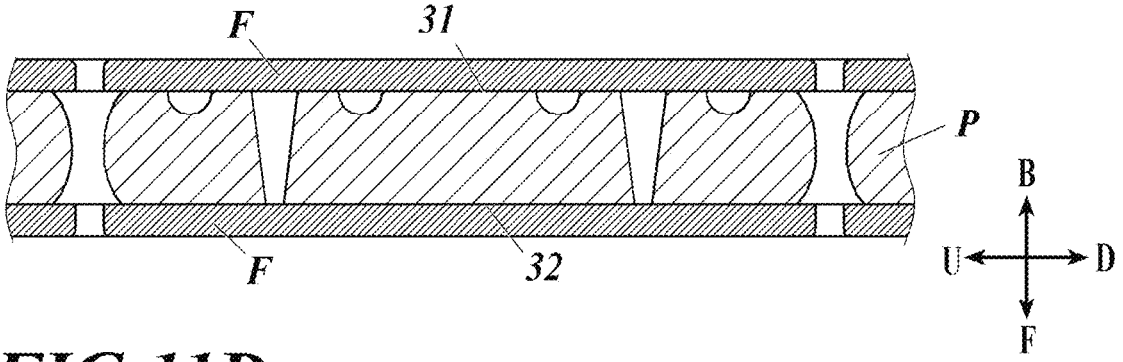
FIG. 11C is a step view that continues from FIG. 11B and illustrates the method of forming (2) the perimeter of the nozzle plate in accordance with wet etching.
Figure 11D:
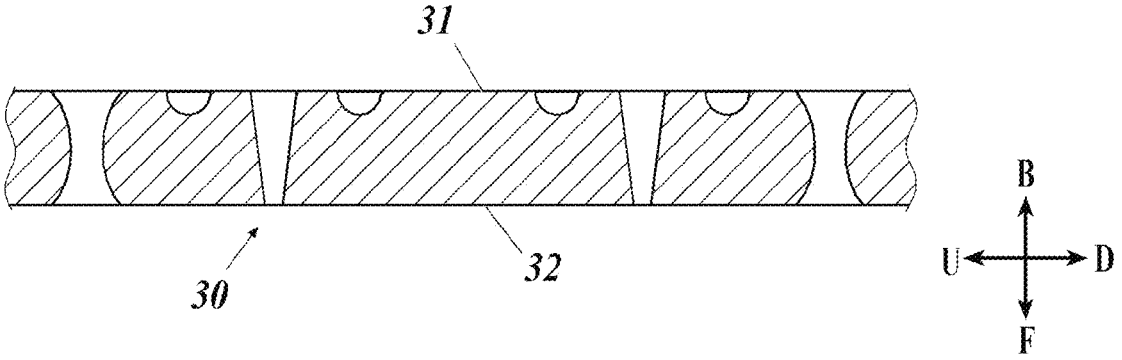
FIG. 11D is a step view that continues from FIG. 11C and illustrates the method of forming (2) the perimeter of the nozzle plate in accordance with wet etching.

In this case, in the formation of the divisions 36, dry film resists are pasted on both surfaces of the plate-like member P (FIG. 11A), the planned positions at which to form each division 36 on both of the first surface 31 and the second surface 32 are exposed through photo masks and dry film resist is removed from the planned positions at which to form each division 36 (FIG. 11B), the divisions 36 are formed by immersion in etching liquid (FIG. 11C), and then the dry film resists are removed (FIG. 11D).

Figure 9E:
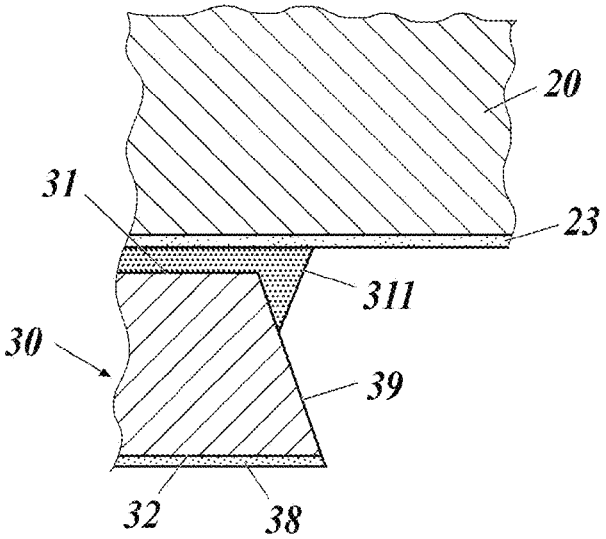
FIG. 9E is a step view that continues from FIG. 9D and illustrates the method of forming (1) the perimeter of the nozzle plate in accordance with wet etching.
Figure 11E:
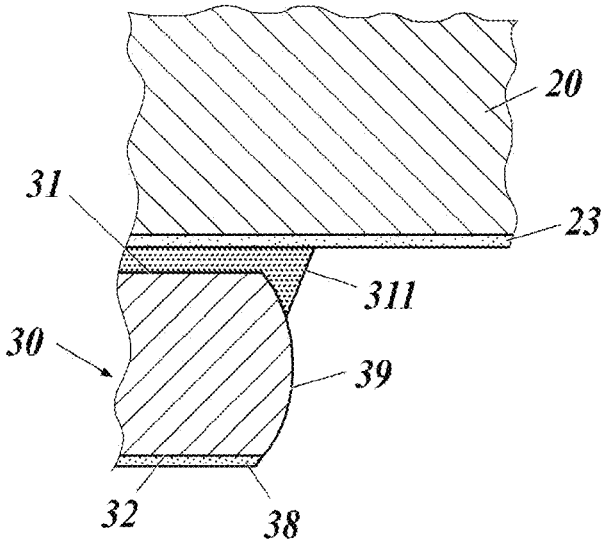
FIG. 11E is a step view that continues from FIG. 11D and illustrates the method of forming (2) the perimeter of the nozzle plate in accordance with wet etching.

In this case as well, as illustrated in FIG. 11E, because, for the nozzle plate 30, an edge at the side of the first surface 31 of the perimeter end surface 39 is formed at with an incline at an obtuse angle with respect to the first surface 31, similarly to the example in FIG. 9E, it is possible to effectively suppress adhesive from going around to the side of the second surface 32 where the water repellent film 38 is formed.

Example (1) of Another Method of Manufacturing Nozzle Plate

An example (1) of another method of manufacturing a nozzle plate is described in accordance with FIG. 12A to FIG. 16. Description for this example of another manufacturing method is given for only points that differ from the manufacturing method illustrated by FIG. 4A to FIG. 8 which is described previously.

This example differs from the manufacturing method of FIG. 4A to FIG. 8 primarily in a point of firstly performing a groove formation step before a nozzle formation step.

Figure 12A:
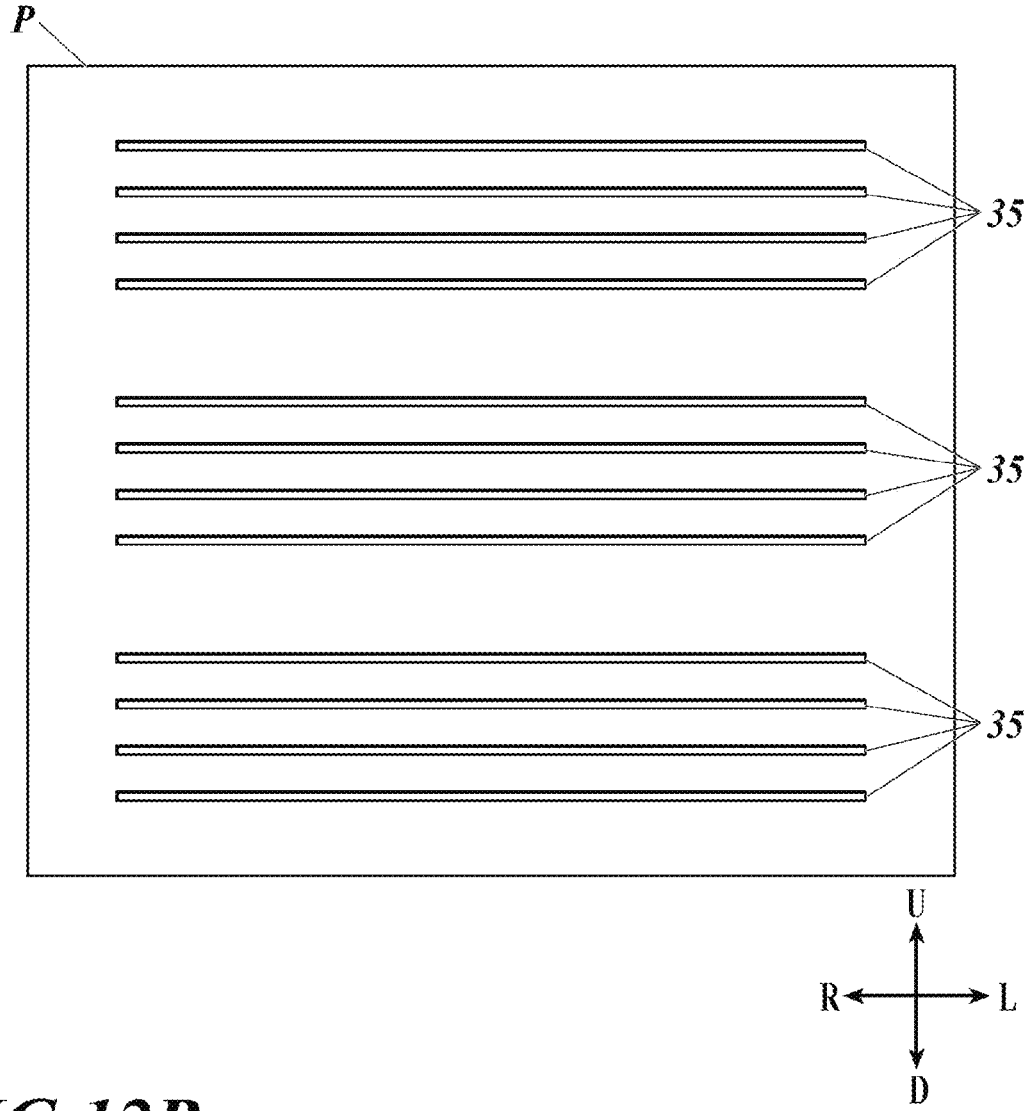
FIG. 12A is a plan view of a metal plate, illustrating a groove formation step in an example (1) of another method of manufacturing a nozzle plate.
Figure 12B:
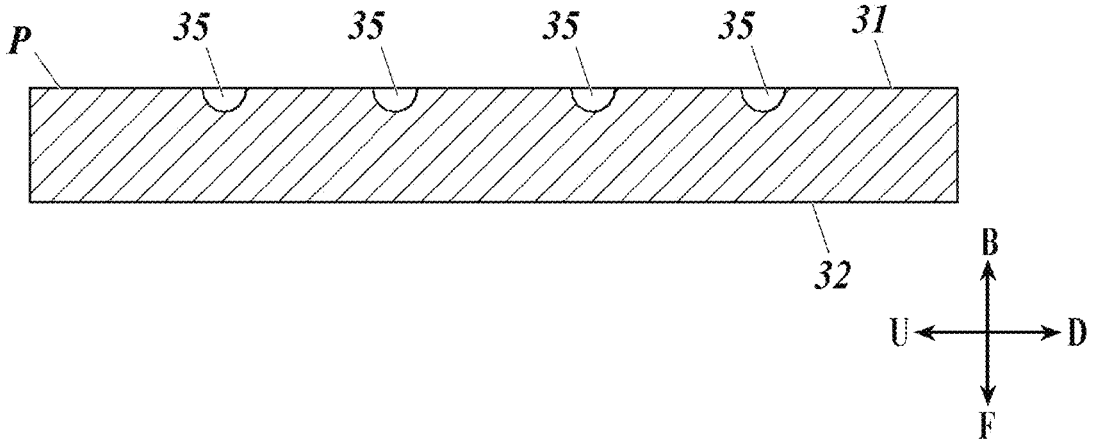
FIG. 12B is a cross-section view taken in forward-backward for the nozzle plate of FIG. 12A.

In other words, as illustrated by FIG. 12A and FIG. 12B, grooves 35 are formed by wet etching the surface that is to be the first surfaces 31 of the plate-like member P (groove formation step). The polishing step for polishing the side of the first surfaces 31 may be performed before this groove formation step.

Figure 13A:
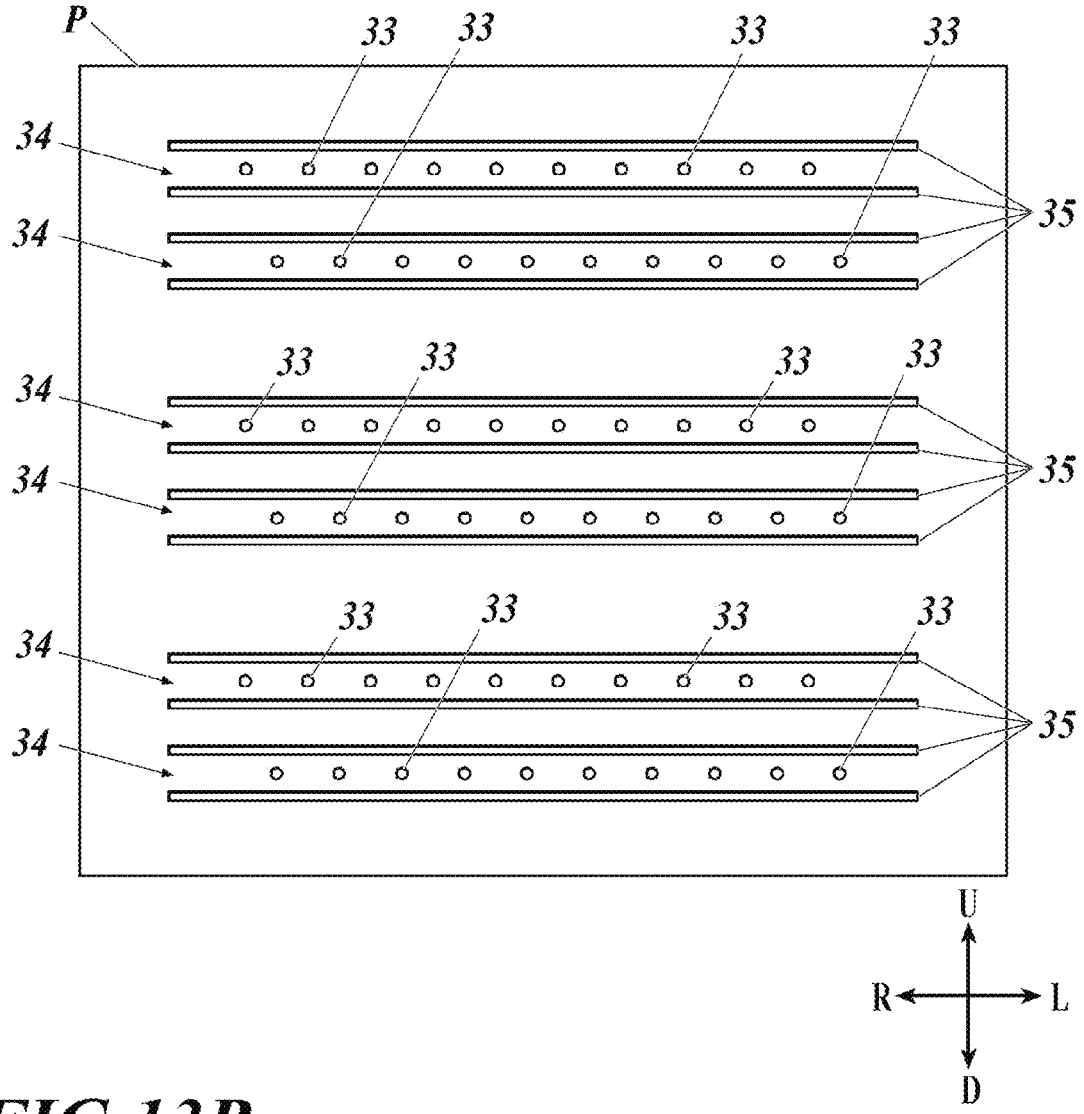
FIG. 13A is a plan view of the metal plate, illustrating a nozzle formation step in the example (1) of another method of manufacturing a nozzle plate.
Figure 13B:
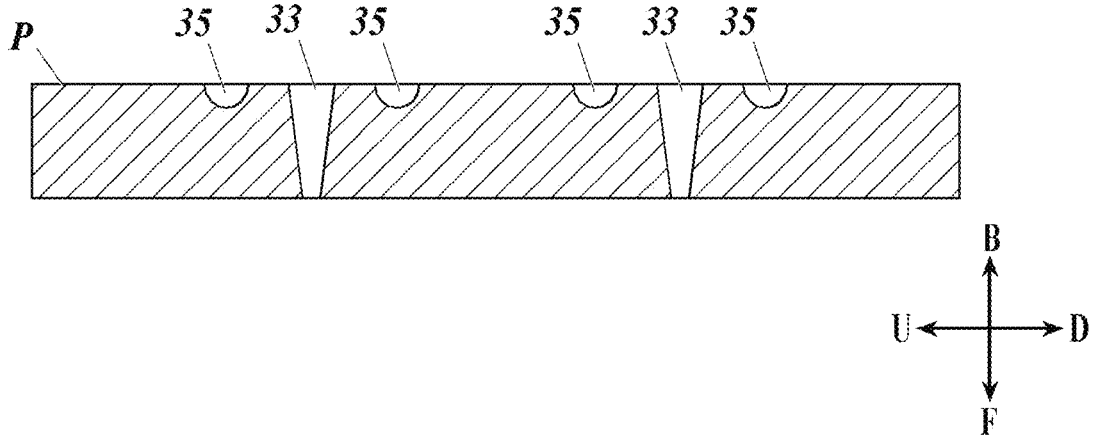
FIG. 13B is a cross-section view following forward-backward for the nozzle plate of FIG. 13A.

Then, as illustrated by FIG. 13A and FIG. 13B, the plurality of nozzles 33 are formed by laser machining, or press working and polishing (nozzle formation step).

Figure 14A:
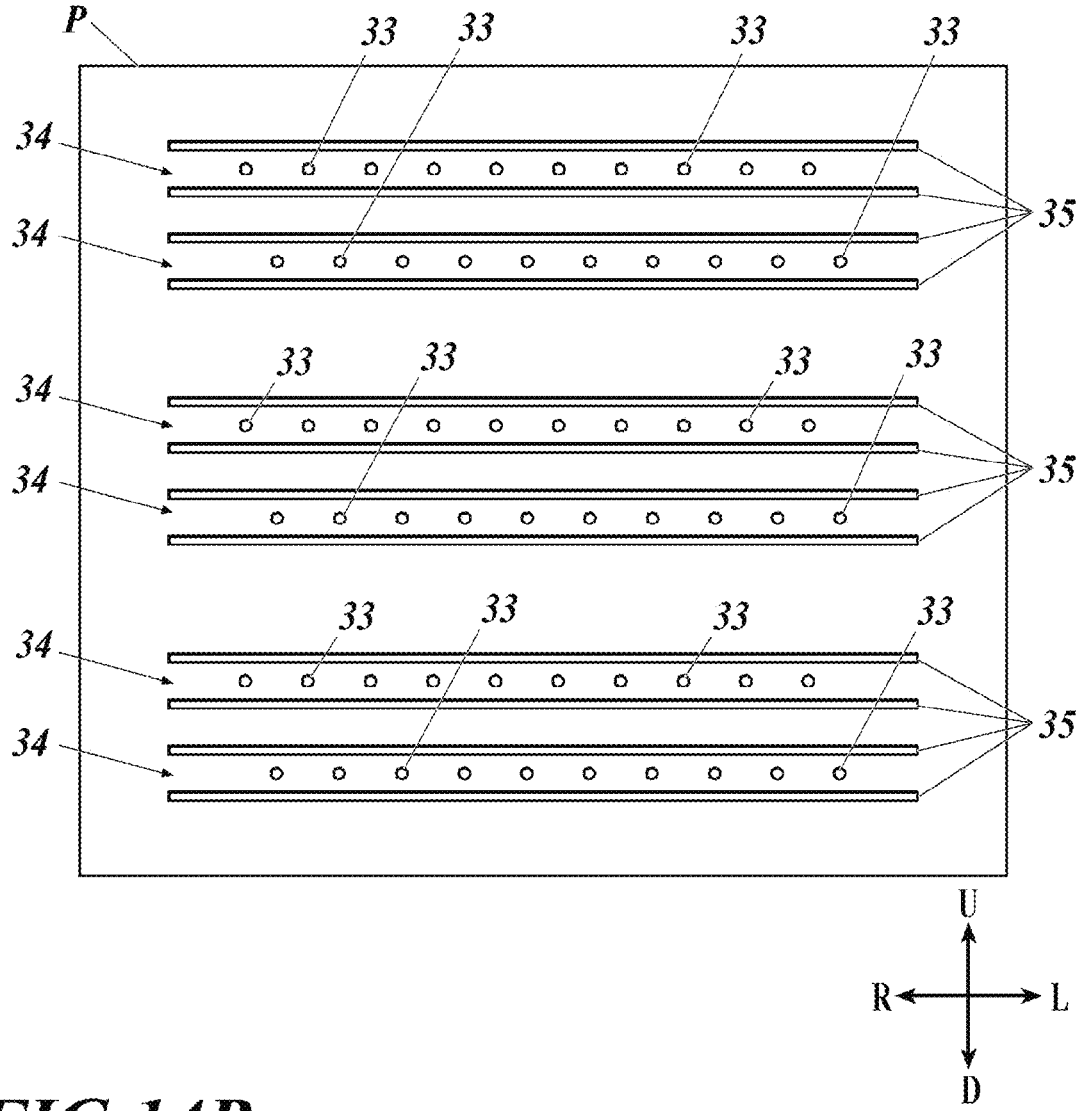
FIG. 14A is a plan view of the metal plate, illustrating a film formation step in the example (1) of another method of manufacturing a nozzle plate.
Figure 14B:
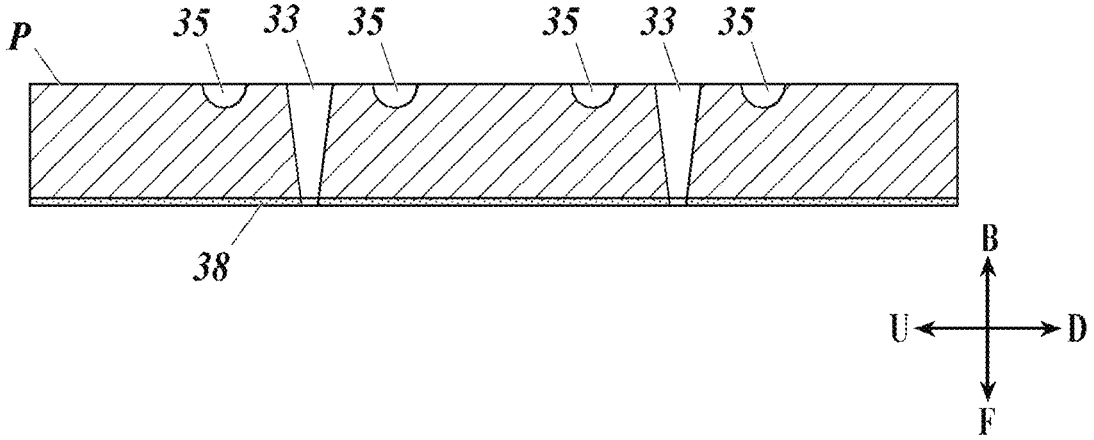
FIG. 14B is a cross-section view taken in forward-backward for the nozzle plate of FIG. 14A.

Next, as illustrated by FIG. 14A and FIG. 14B, the water repellent film 38 is formed on a surface of the plate-like member P that is to be the second surfaces 32 (film formation step).

Figure 15A:
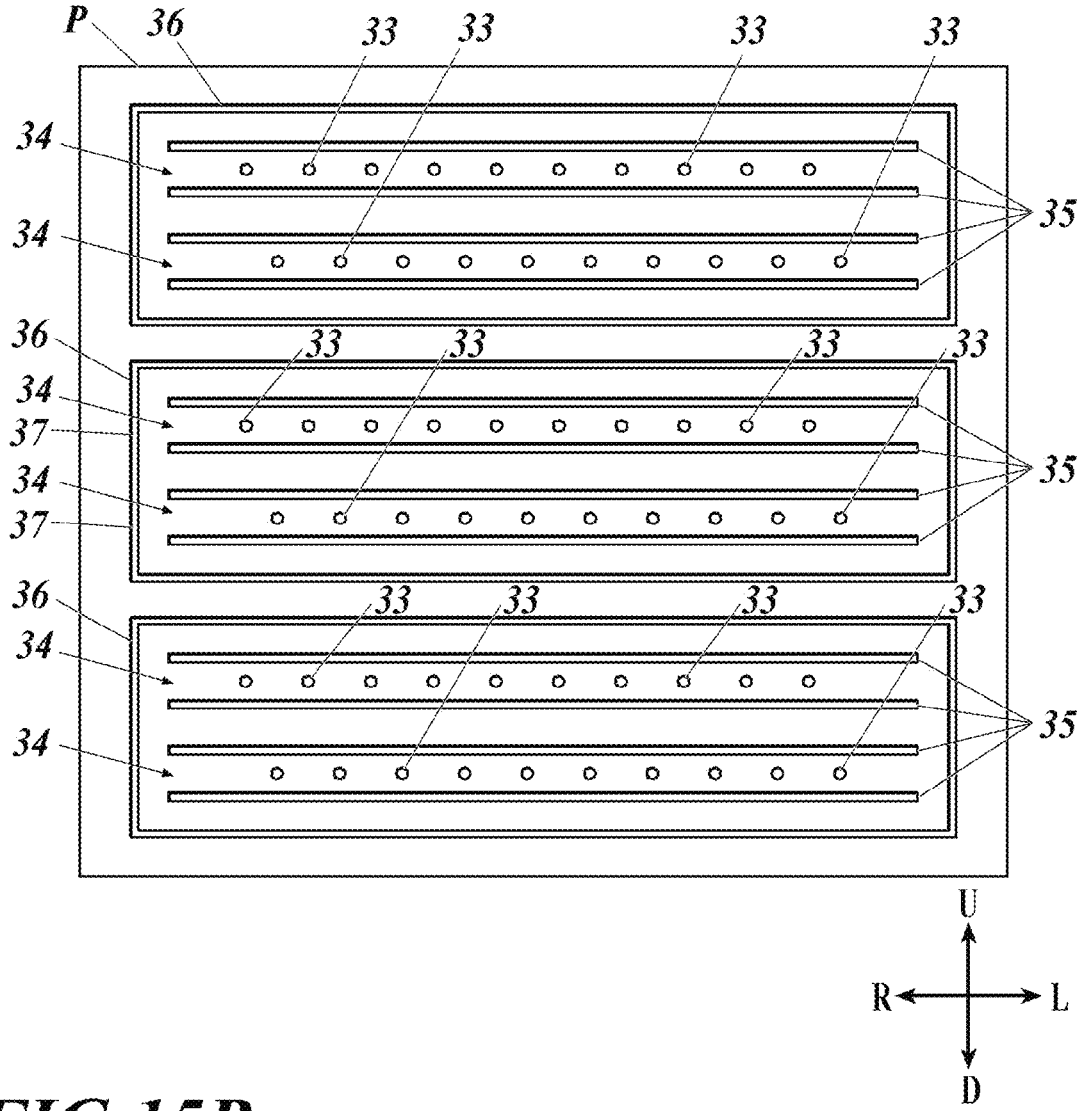
FIG. 15A is a plan view of the metal plate, illustrating an exterior processing step in the example (1) of another method of manufacturing a nozzle plate.
Figure 15B:
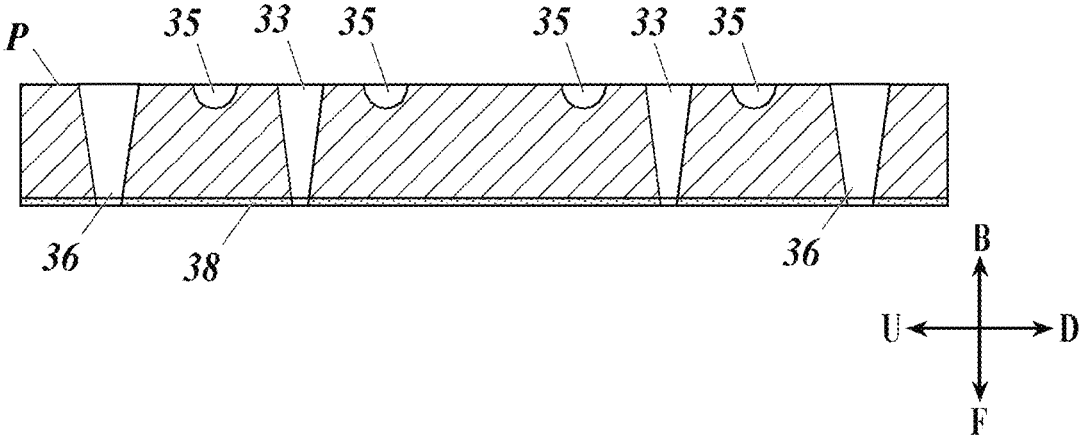
FIG. 15B is a cross-section view taken in forward-backward for the nozzle plate of FIG. 15A.
Figure 16:
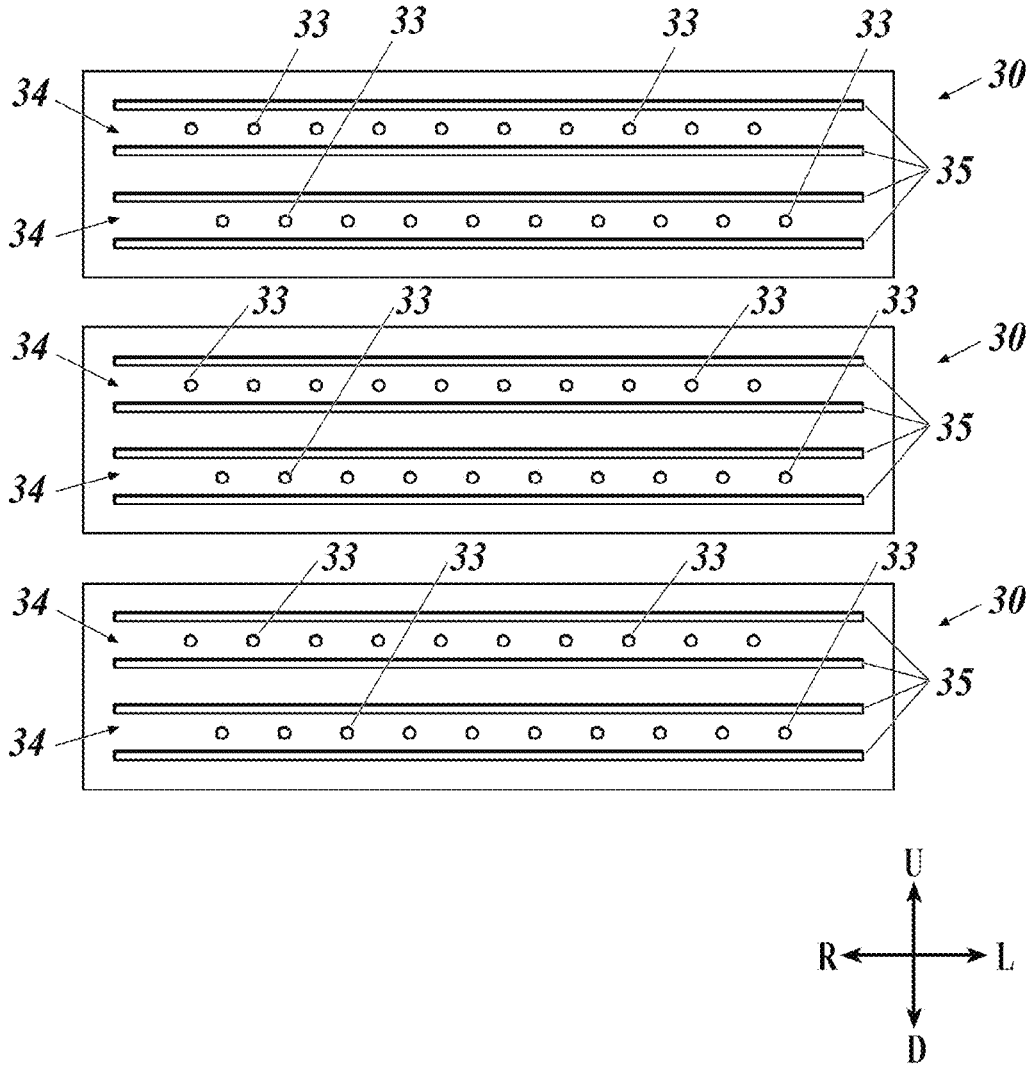
FIG. 16 is a plan view of the metal plate, illustrating a separation step in the example (1) of another method of manufacturing a nozzle plate.

Next, as illustrated by FIG. 15A and FIG. 15B, divisions 36 that do not keep bridges 37 are formed by wet etching or laser machining on the plate-like member P along the exterior of the nozzle plates 30 (exterior processing step). By this, as illustrated by FIG. 16, the nozzle plates 30 are separated from the plate-like member P (separation step).

After the nozzle formation step of FIG. 13A and FIG. 13B, the exterior processing step, the film formation step, and the separation step illustrated in FIG. 6A to FIG. 8 described previously may be performed.

Conversely, in the manufacturing method illustrated in FIG. 4A to FIG. 8 described above, the film formation step, the exterior processing step, and the separation step illustrated in FIG. 14A to FIG. 16 may be performed after the groove formation step of FIG. 5A and FIG. 5B.

Example (2) of Another Method of Manufacturing Nozzle Plate

An example (2) of another method of manufacturing a nozzle plate is described in accordance with FIG. 17A to FIG. 21. Description for this example of another manufacturing method is given for only points that differ from the manufacturing method illustrated by FIG. 4A to FIG. 8 which is described previously.

This example differs from the manufacturing method of FIG. 4A to FIG. 8 primarily in a point that the film formation step is performed first.

Figure 17A:
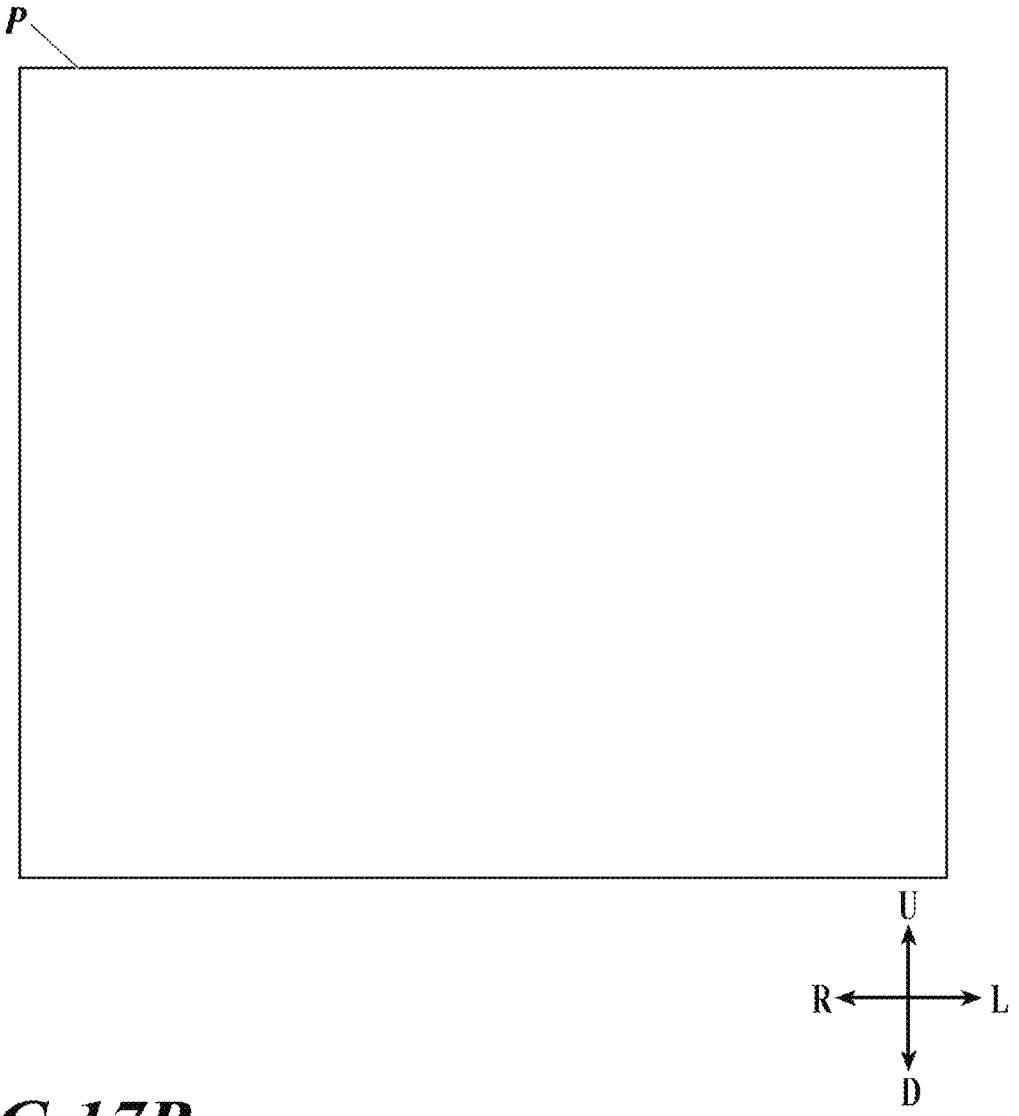
FIG. 17A is a plan view of a metal plate, illustrating a film formation step in an example (2) of another method of manufacturing a nozzle plate.
Figure 17B:
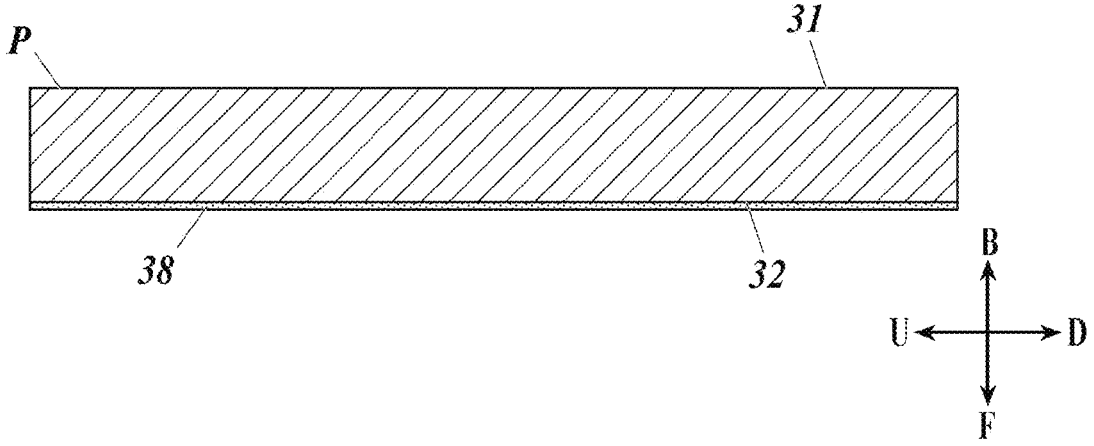
FIG. 17B is a cross-section view taken in forward-backward for the nozzle plate of FIG. 17A.

That is, as illustrated by FIG. 17A and FIG. 17B, the water repellent film 38 is formed on a surface of the plate-like member P that is to be the second surfaces 32 (film formation step).

Figure 18A:
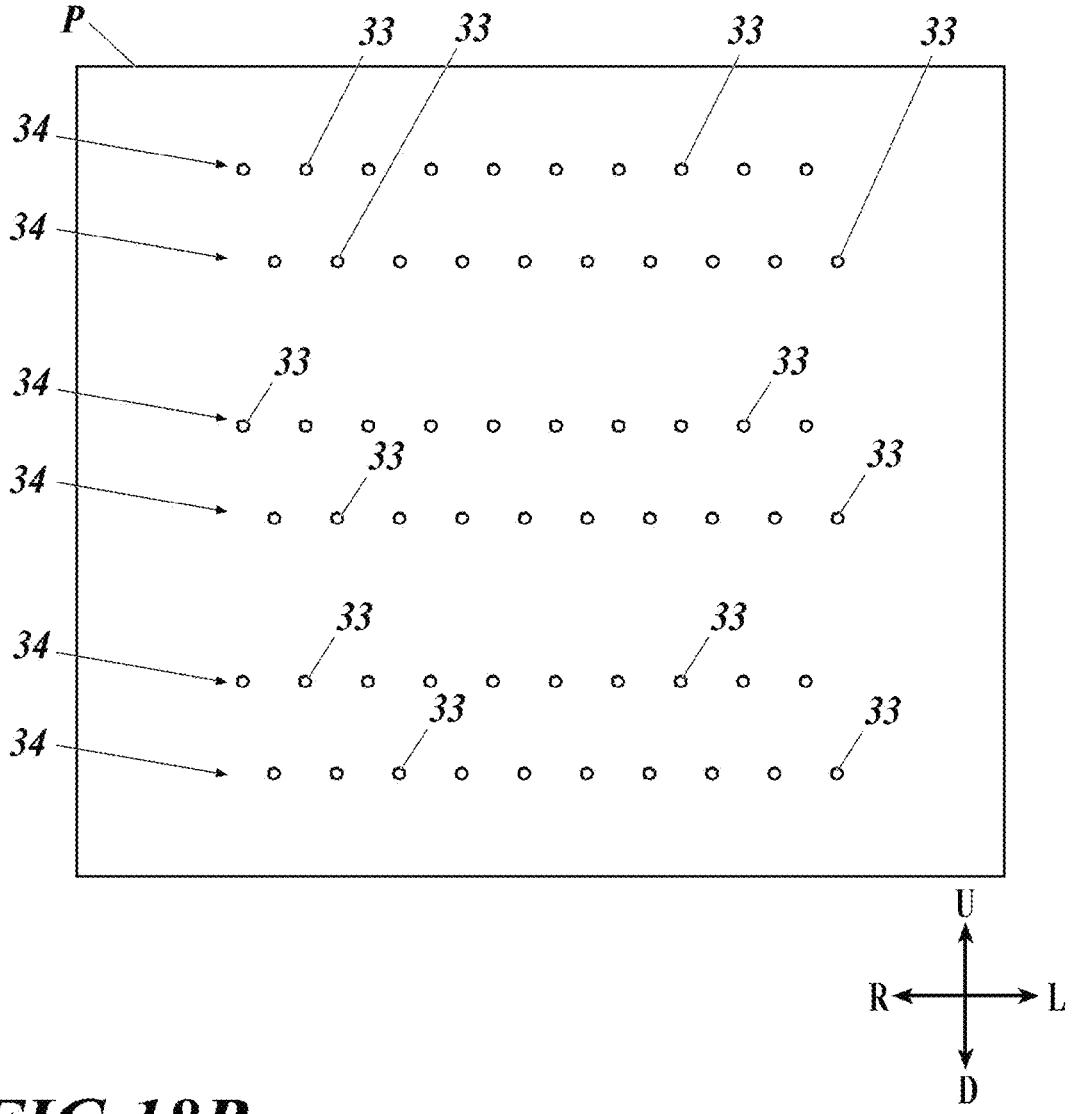
FIG. 18A is a plan view of the metal plate, illustrating a nozzle formation step in the example (2) of another method of manufacturing a nozzle plate.
Figure 18B:
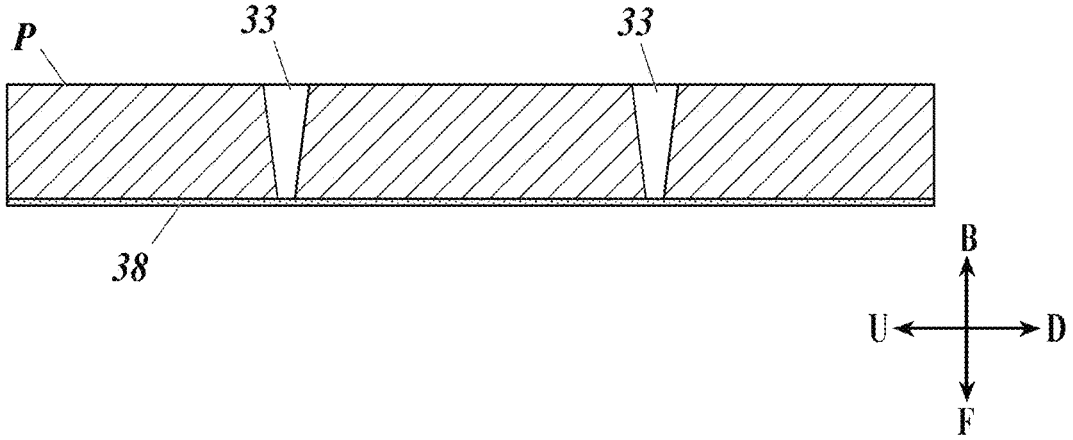
FIG. 18B is a cross-section view taken in forward-backward for the nozzle plate of FIG. 18A.

Then, as illustrated by FIG. 18A and FIG. 18B, the plurality of nozzles 33 are formed by laser machining (nozzle formation step).

Figure 19A:
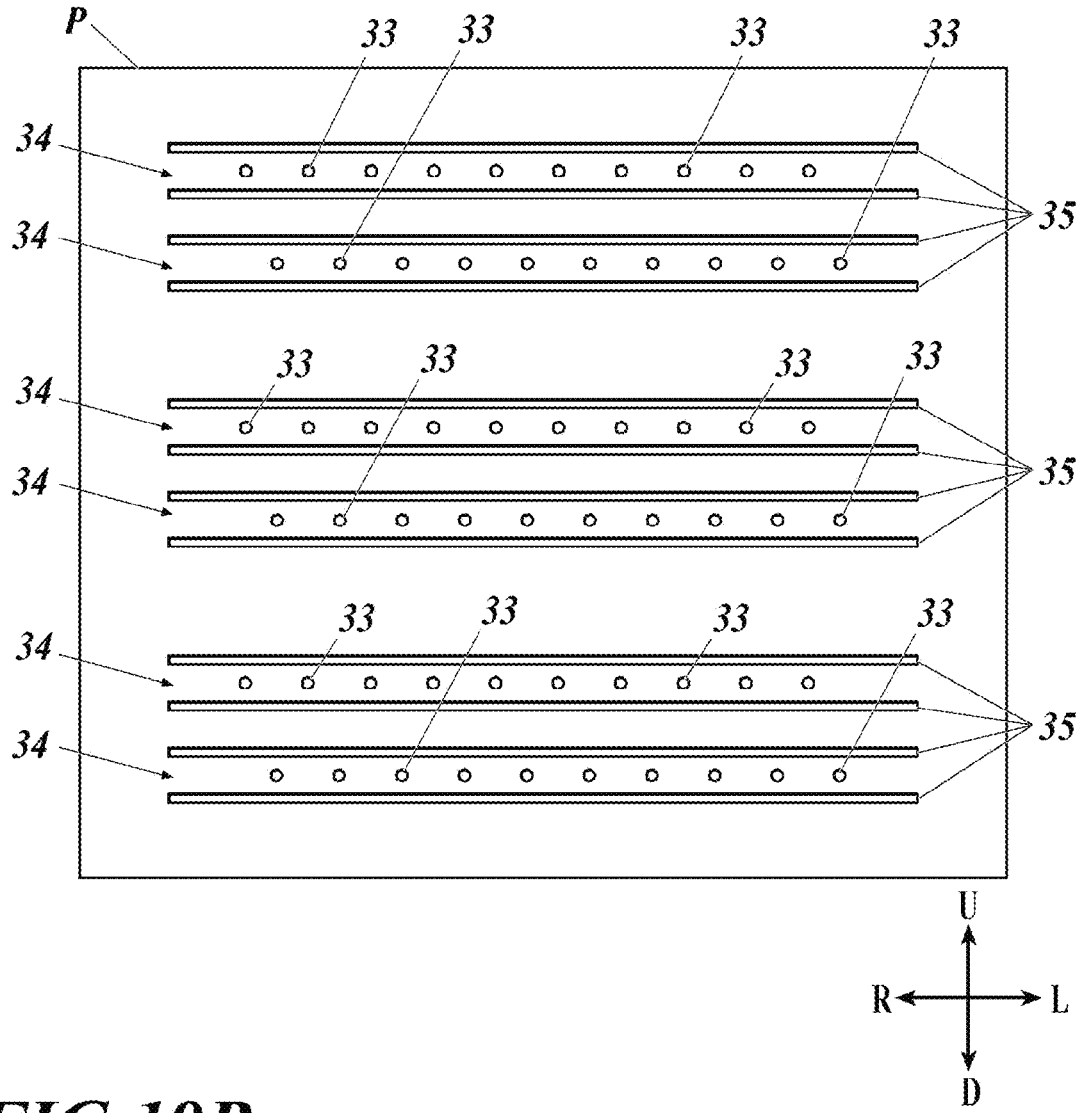
FIG. 19A is a plan view of the metal plate, illustrating a groove formation step in the example (2) of another method of manufacturing a nozzle plate.
Figure 19B:
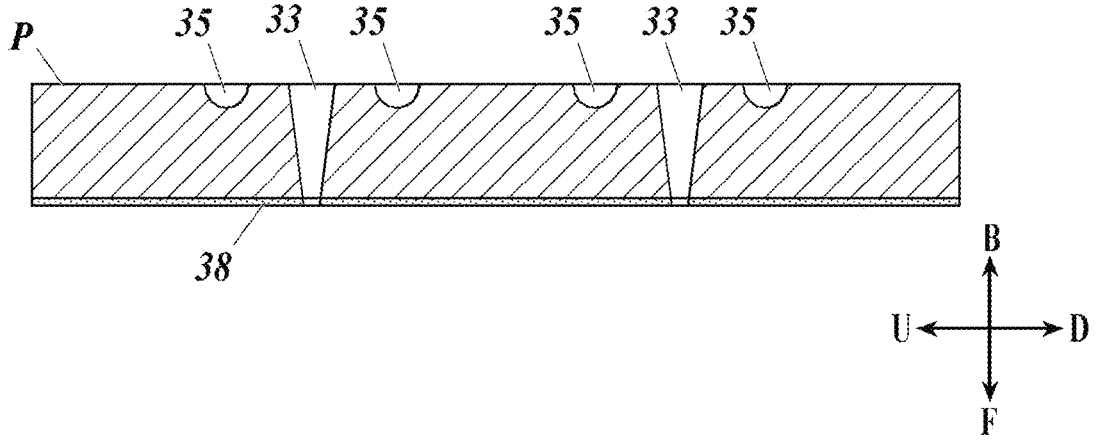
FIG. 19B is a cross-section view taken in forward-backward for the nozzle plate of FIG. 19A.

Next, as illustrated by FIG. 19A and FIG. 19B, grooves 35 are formed by wet etching the surface that is to be the first surfaces 31 of the plate-like member P (groove formation step). The polishing step for polishing the side of the first surfaces 31 may be performed before this groove formation step.

Figure 20A:
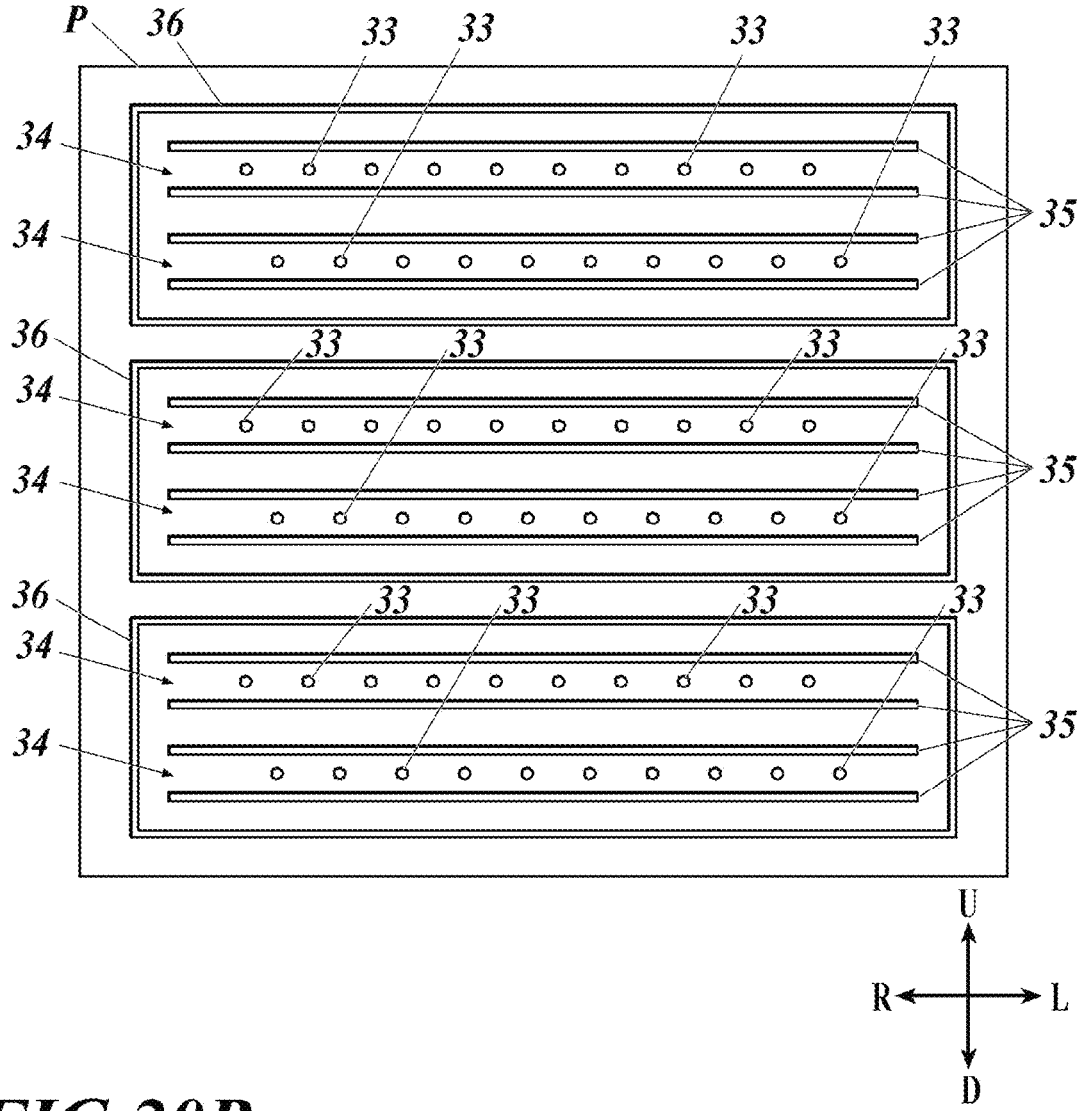
FIG. 20A is a plan view of the metal plate, illustrating an exterior processing step in the example (2) of another method of manufacturing a nozzle plate.
Figure 20B:
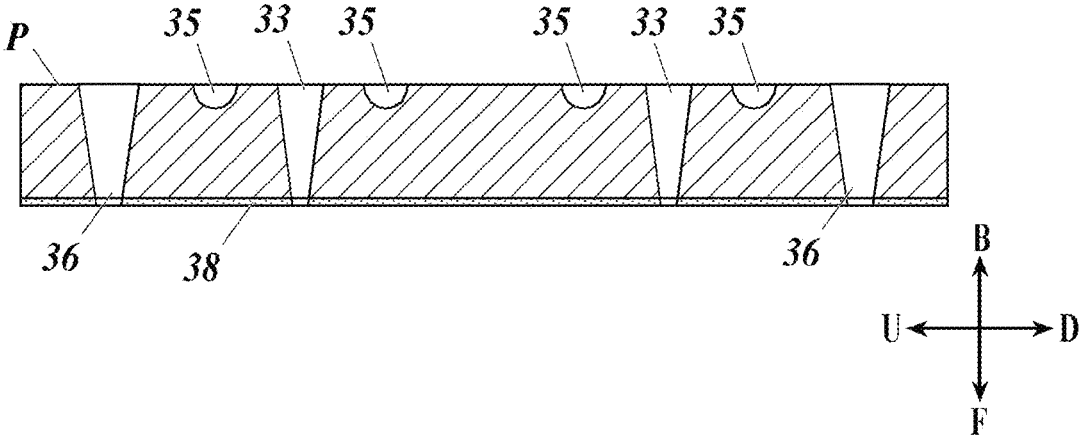
FIG. 20B is a cross-section view taken in forward-backward for the nozzle plate of FIG. 20A.
Figure 21:
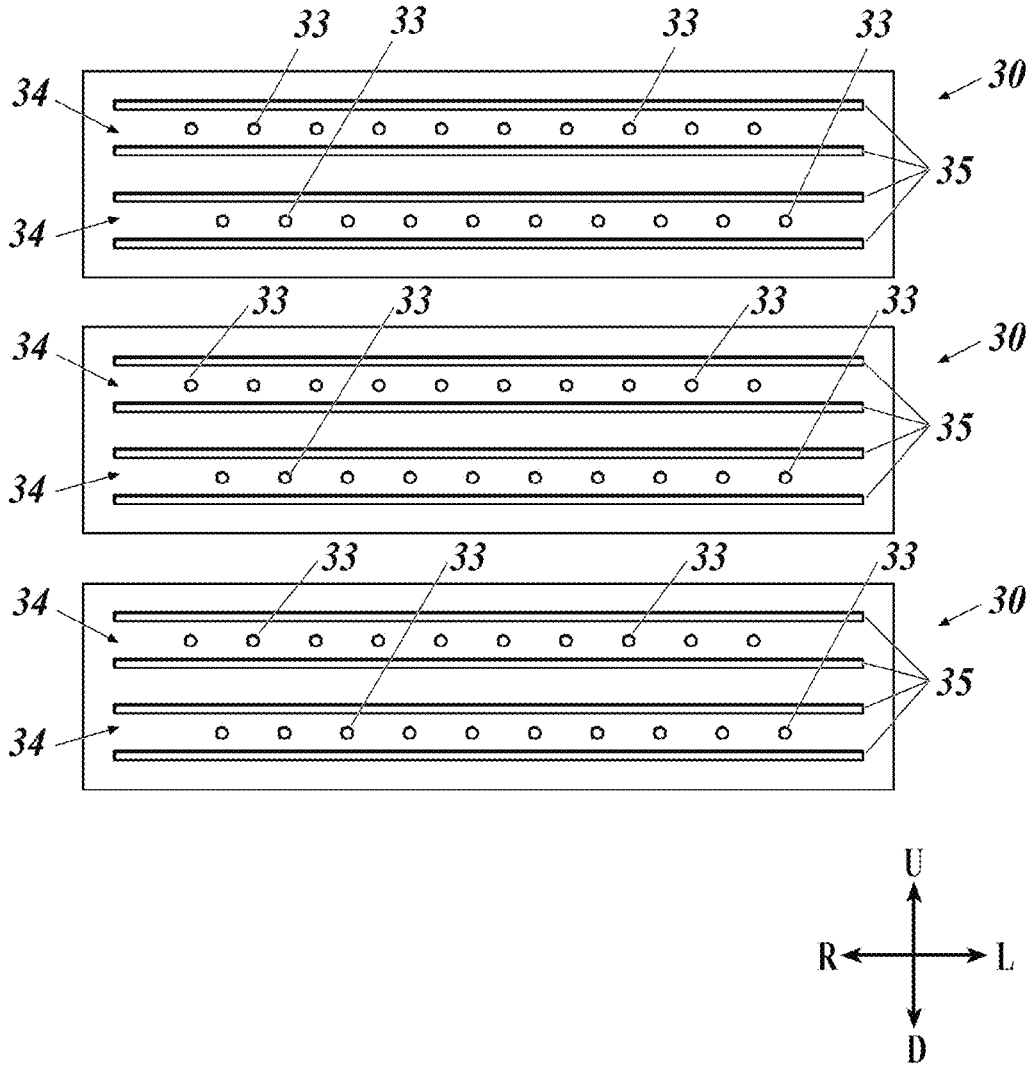
FIG. 21 is a plan view of the metal plate, illustrating a separation step in an example (2) of another method of manufacturing a nozzle plate.

Next, as illustrated by FIG. 20A and FIG. 20B, divisions 36 that do not keep bridges 37 are formed by wet etching or laser machining on the plate-like member P along the exterior of the nozzle plates 30 (exterior processing step). By this, as illustrated by FIG. 21, the nozzle plates 30 are separated from the plate-like member P (separation step).

The nozzle formation step illustrated in FIG. 18A and FIG. 18B and the groove formation step illustrated by FIG. 19A and FIG. 19B may be swapped in order.

Example (3) of Another Method of Manufacturing Nozzle Plate

An example (3) of another method of manufacturing a nozzle plate is described in accordance with FIG. 22A to FIG. 26. Description for this example of another manufacturing method is given for only points that differ from the manufacturing method illustrated by FIG. 4A to FIG. 8 which is described previously.

This example differs from the manufacturing method of FIG. 4A to FIG. 8 primarily in a point of first performing the film formation step before the groove formation step.

Figure 22A:
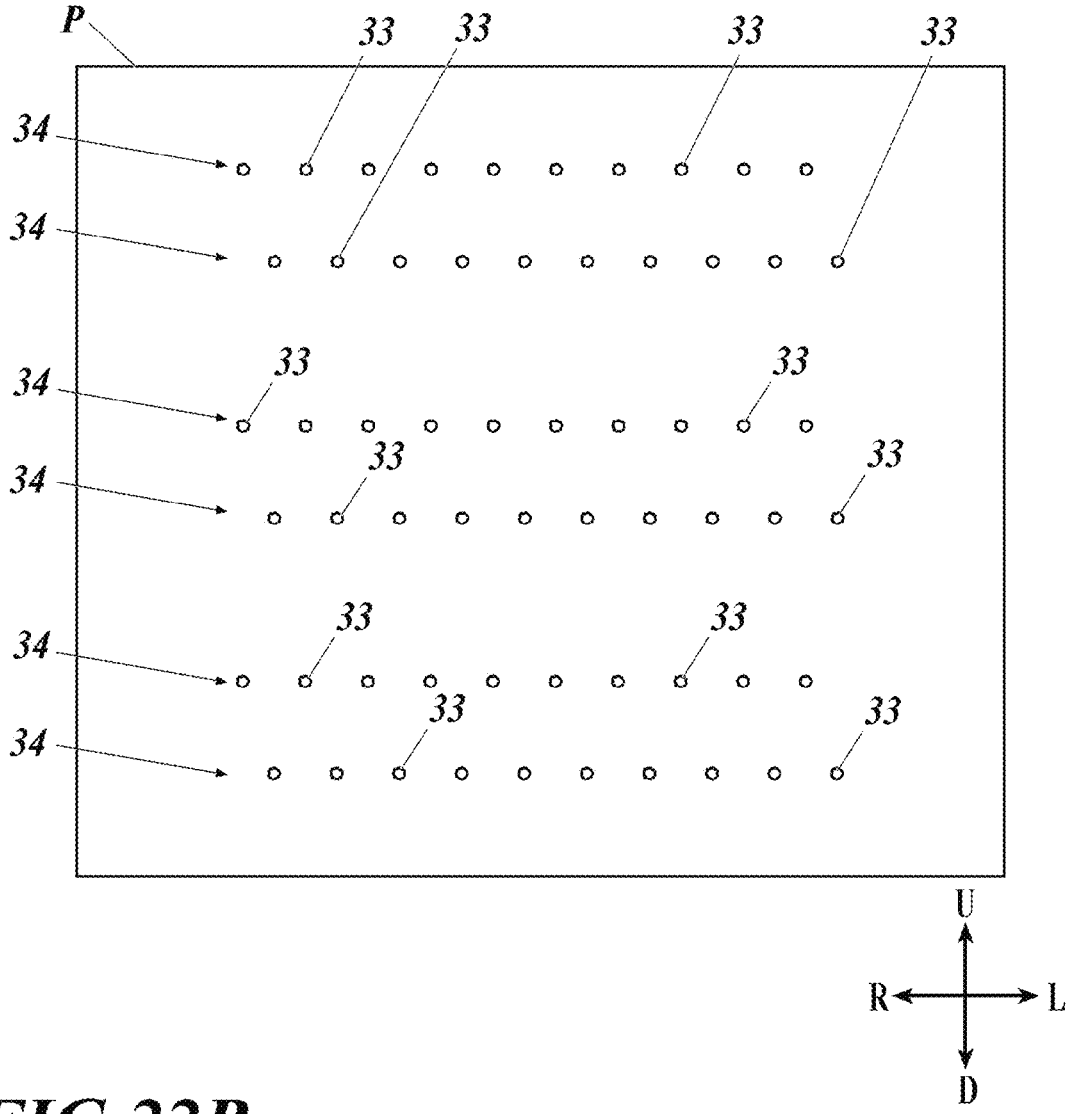
FIG. 22A is a plan view of a metal plate, illustrating a nozzle formation step in an example (3) of another method of manufacturing a nozzle plate.
Figure 22B:
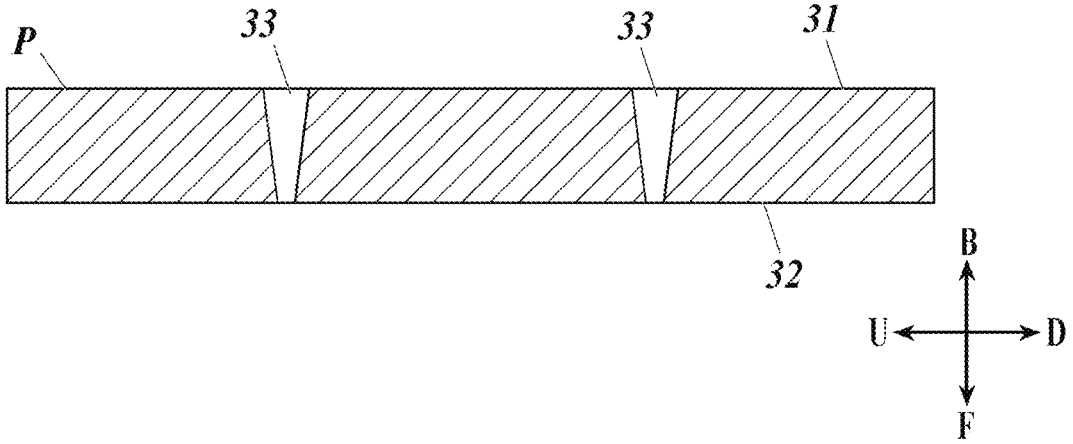
FIG. 22B is a cross-section view taken in forward-backward for the nozzle plate of FIG. 22A.

In other words, as illustrated by FIG. 22A and FIG. 22B, the plurality of nozzles 33 are formed by laser machining, or press working and polishing (nozzle formation step).

Figure 23A:
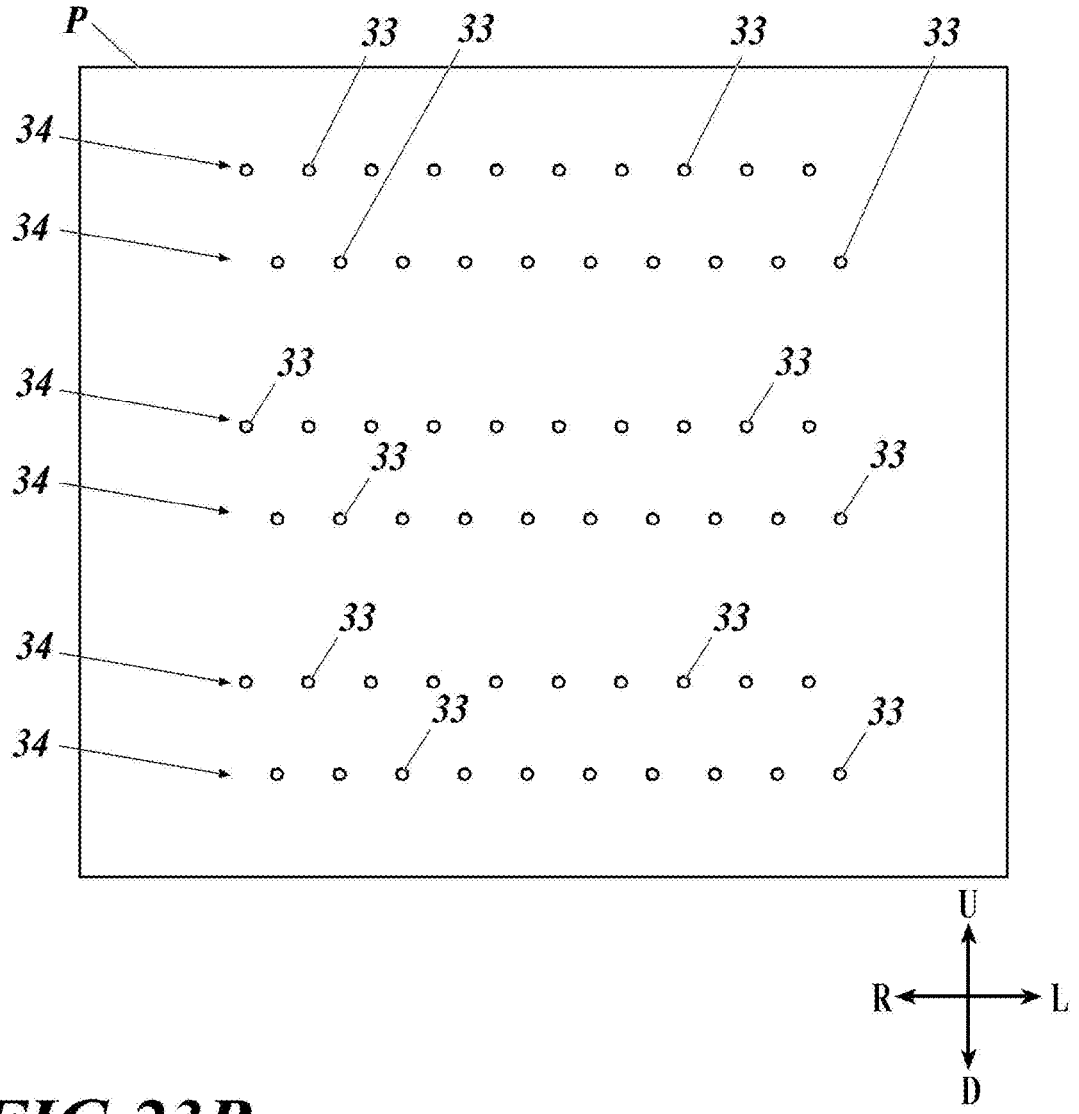
FIG. 23A is a plan view of the metal plate, illustrating a film formation step in the example (3) of another method of manufacturing a nozzle plate.
Figure 23B:
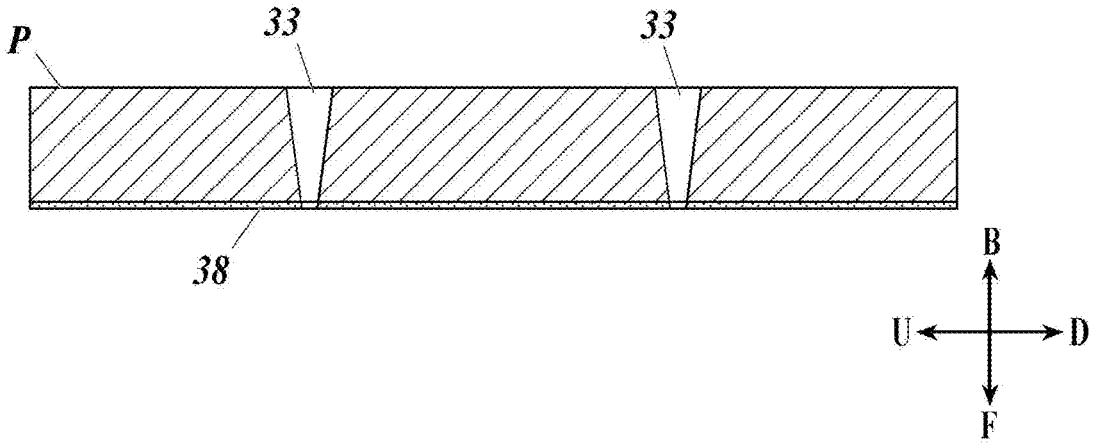
FIG. 23B is a cross-section view taken in forward-backward for the nozzle plate of FIG. 23A.

Next, as illustrated by FIG. 23A and FIG. 23B, the water repellent film 38 is formed on a surface of the plate-like member P that is to be the second surfaces 32 (film formation step).

Figure 24A:
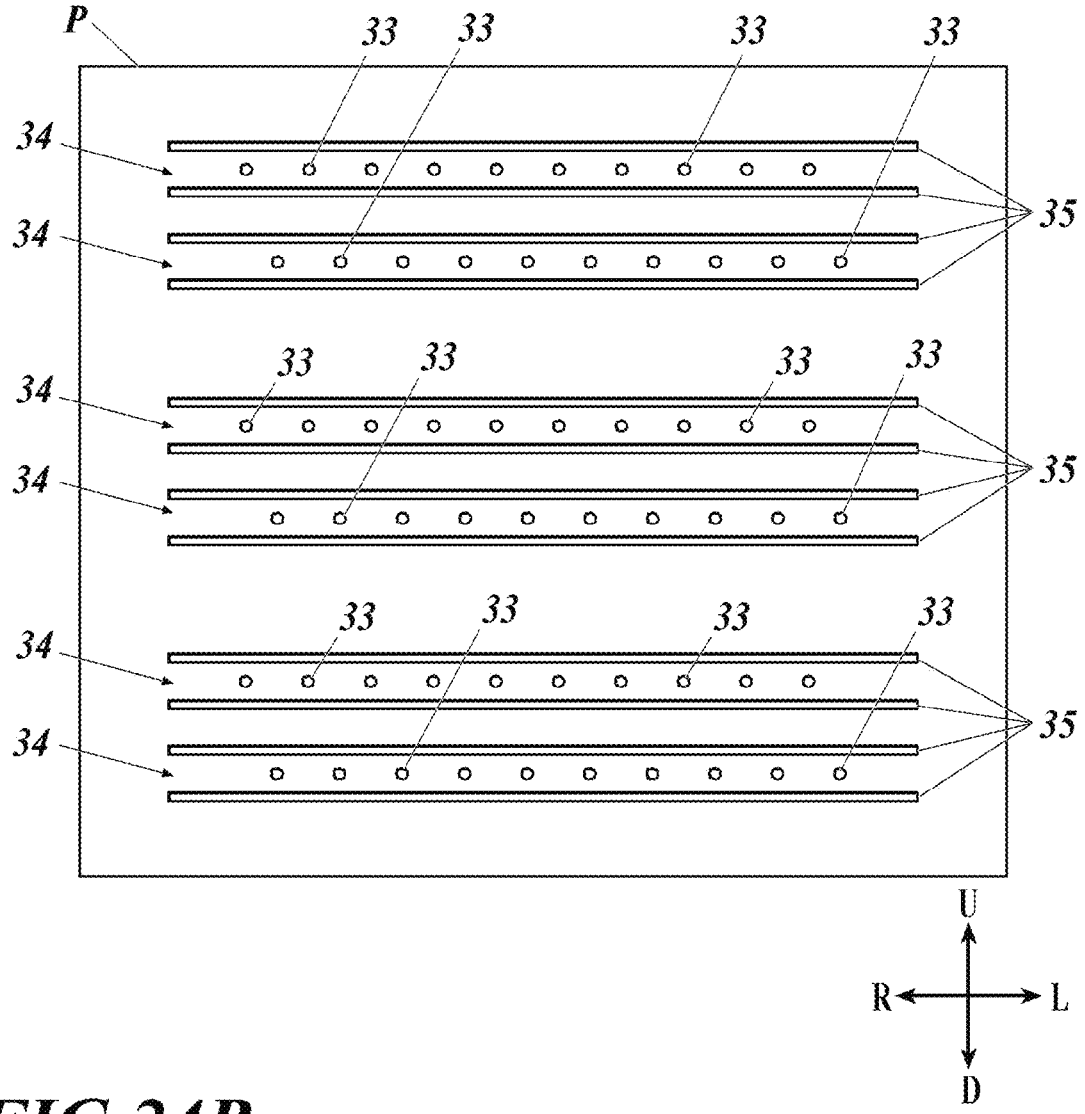
FIG. 24A is a plan view of the metal plate, illustrating a groove formation step in an example (3) of another method of manufacturing a nozzle plate.
Figure 24B:
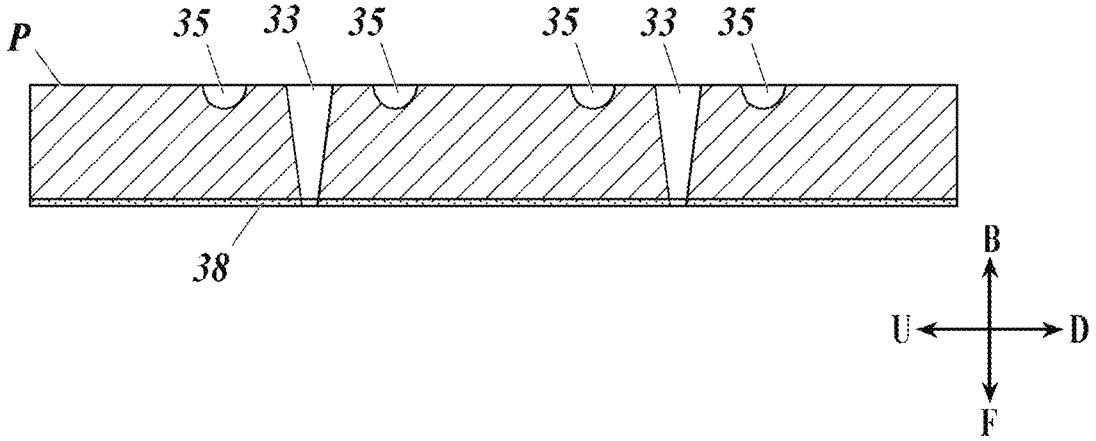
FIG. 24B is a cross-section view taken in forward-backward for the nozzle plate of FIG. 24A.

Next, as illustrated by FIG. 24A and FIG. 24B, the grooves 35 are formed by wet etching the surface that is to be the first surfaces 31 of the plate-like member P (groove formation step). The polishing step for polishing the side of the first surfaces 31 may be performed before this groove formation step.

Figure 25A:
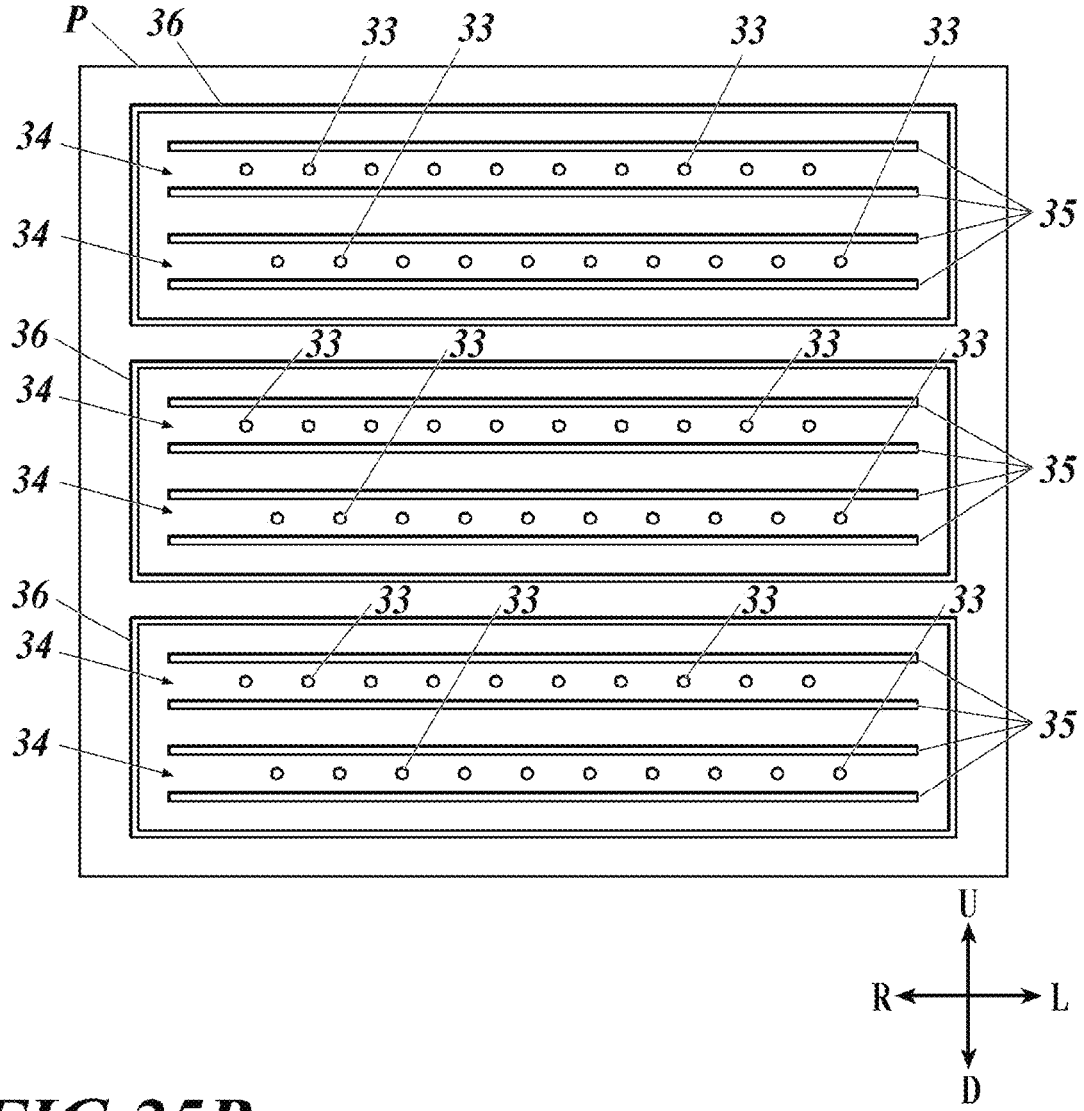
FIG. 25A is a plan view of the metal plate, illustrating an exterior processing step in the example (3) of another method of manufacturing a nozzle plate.
Figure 25B:
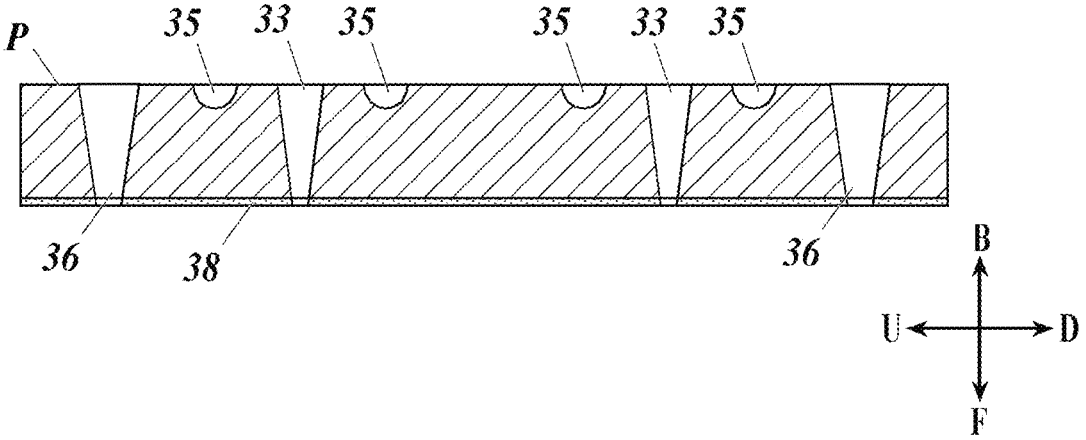
FIG. 25B is a cross-section view taken in forward-backward for the nozzle plate of FIG. 25A.
Figure 26:
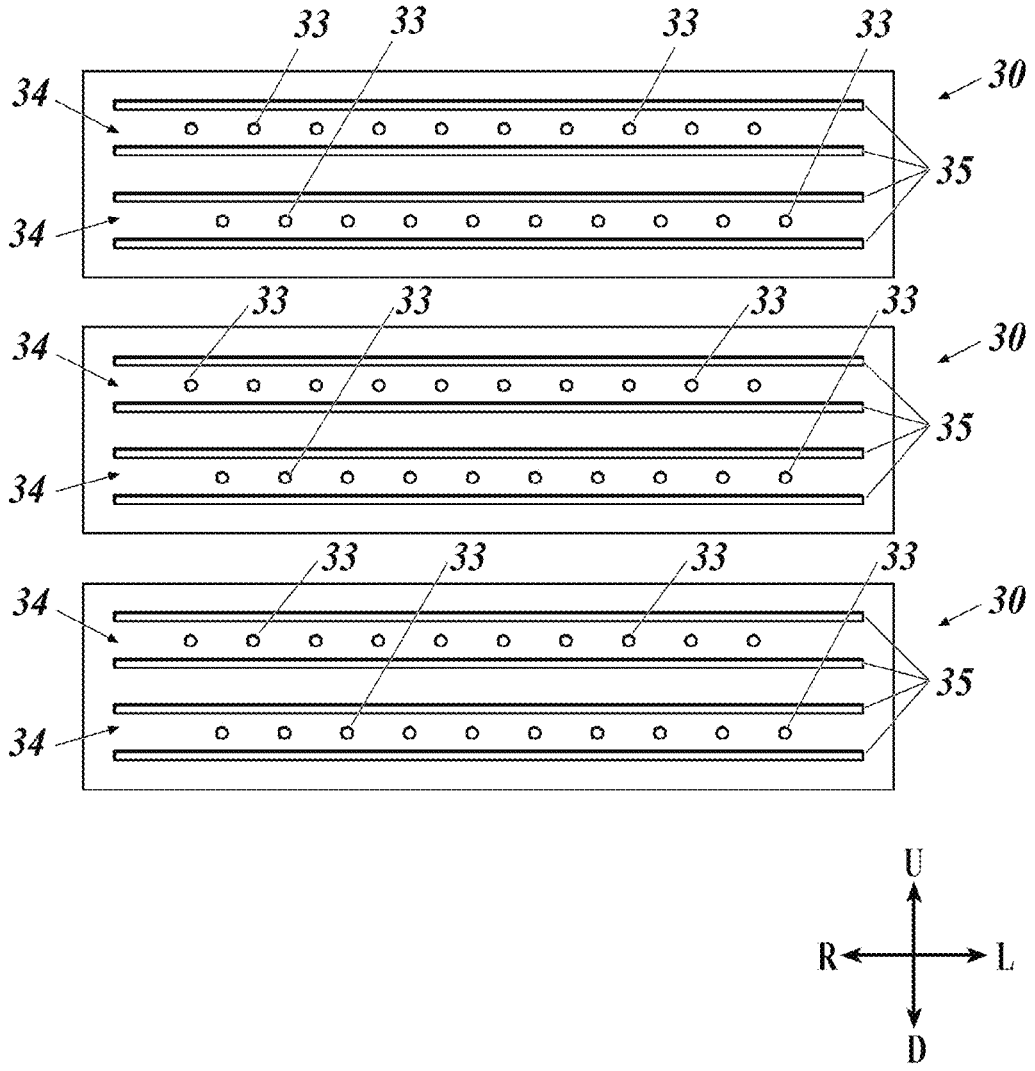
FIG. 26 is a plan view of the metal plate, illustrating a separation step in the example (3) of another method of manufacturing a nozzle plate.

Next, as illustrated by FIG. 25A and FIG. 25B, the divisions 36 that do not keep bridges 37 are formed by wet etching or laser machining on the plate-like member P along the exterior of the nozzle plates 30 (exterior processing step). By this, as illustrated by FIG. 26, the nozzle plates 30 are separated from the plate-like member P (separation step).

The nozzle formation step illustrated in FIG. 23A and FIG. 23B and the groove formation step illustrated by FIG. 24A and FIG. 24B may be swapped in order.

In the examples (1) to (3) of other manufacturing methods described above, it is possible to omit the film formation step in accordance with intended use of the nozzle plate.

Technical Effects of Embodiments of the Invention

As described above, the nozzle plate 30 manufactured from a plate-like member P, which is made of metal and that has undergone a nozzle formation step, a groove formation step, and an exterior processing step, has excellent durability and chemical resistance, and, because the grooves 35 can suppress blockage of the nozzles 33 by adhesive, has excellent discharge characteristics. Accordingly, by mounting the nozzle plate 30, it is possible to provide the inkjet head 10 which has excellent durability, chemical resistance, and discharge characteristics.

Because the nozzle rows 34 are formed in the nozzle plate 30 and the grooves 35 are formed in the nozzle plate 30 parallel to the nozzle rows 34, it is possible to uniformly suppress inflow of adhesive to the nozzles 33.

Because each groove 35 is longer than a nozzle row 34 and formed so that the nozzle row 34 fits inside the groove 35 in relation to the left/right direction, it is possible to effectively suppress inflow of adhesive across the entire length of the nozzle row 34.

Because grooves 35 are formed on both sides so as to sandwich each nozzle row 34, it is also possible to suppress inflow of adhesive from both sides in directions orthogonal to the longitudinal direction of the nozzle row 34.

Because each groove 35 is formed with a depth in a range of 5 to 20 μm, it is also possible to maintain the nozzle plate 30 at an appropriate strength while appropriately ensuring of the capacity for adhesive.

For the nozzle plate 30, each groove 35 is formed by wet etching. The groove 35 has a structure in which it is formed in the first surface 31 of the nozzle plate 30 and does not penetrate the second surface 32. If such a bottomed groove is formed by laser machining or press working, a difference in residual stress will occur between a groove bottom side (on the side of the second surface 32) and a groove opening (on the side of the first surface 31), and warping of the nozzle plate 30 will be more likely to occur.

However, because each groove 35 is formed by wet etching, it is possible to effectively suppress the occurrence of warping of the nozzle plate 30.

Accordingly, it becomes possible to reduce the occurrence of locations where there is poor adherence due to warping when adhering the nozzle plate 30 to the head chip 20, and to provide the inkjet head 10 which has high reliability.

In the steps for manufacturing the nozzle plate 30 that are illustrated in FIG. 4A to FIG. 8, in relation to a plate-like member P, a film formation step for forming a water repellent film on the plate-like member P is performed after an exterior processing step for, along the exterior of the nozzle plate 30, forming the divisions 36 while keeping some bridges 37.

In this case, because each nozzle plate 30 is connected to the plate-like member P through the bridges 37, it is possible to form the water repellent film while the nozzle plates 30 are held by the portion of the plate-like member P other than the nozzle plates 30.

Accordingly, in comparison to a case of forming the water repellent film after separating the individual nozzle plates 30, it is possible to satisfactorily form the water repellent film 38 on the nozzle plate 30 without formation of the water repellent film being obstructed by the nozzle plate 30 being held (for example, if the nozzle plate 30 is fixed by tape).

Work to separately fix the nozzle plate 30 is unnecessary, and it is possible to more easily manufacture the nozzle plate 30 and achieve a reduction in a workload.

As in the example (1) of another method of manufacturing a nozzle plate that is illustrated in FIG. 12A to FIG. 16, even in a case where the film formation step is performed after the groove formation step and before the separation step for separating the nozzle plate 30 from the plate-like member P in the process of manufacturing the nozzle plate 30, it is possible to satisfactorily form the water repellent film 38 on the nozzle plate 30 without formation of the water repellent film being obstructed.

In the steps for manufacturing the nozzle plate 30, a polishing step for polishing the plate-like member P is provided after the nozzle formation step and before the groove formation step.

By this, it becomes possible to satisfactorily form a photoresist film for forming the grooves 35 by wet etching, and it becomes possible to satisfactorily form each groove 35 with good accuracy.

In the nozzle formation step, each nozzle 33 is formed by press working and polishing, or by laser machining. Because each nozzle 33 is formed by penetrating the plate-like member P, it is less likely for a difference in residual stress for the thickness direction of the plate-like member P, and less likely for warping to occur, which differs to the case for the groove 35 described above. If warping occurs, it is possible to reduce the warping by polishing both surfaces and adjusting the amount of polishing.

By forming each nozzle 33 by press working and polishing or by laser machining, it is also possible to efficiently manufacture them.

Another Example (1) of Forming Grooves in Nozzle Plate

Figure 27A:
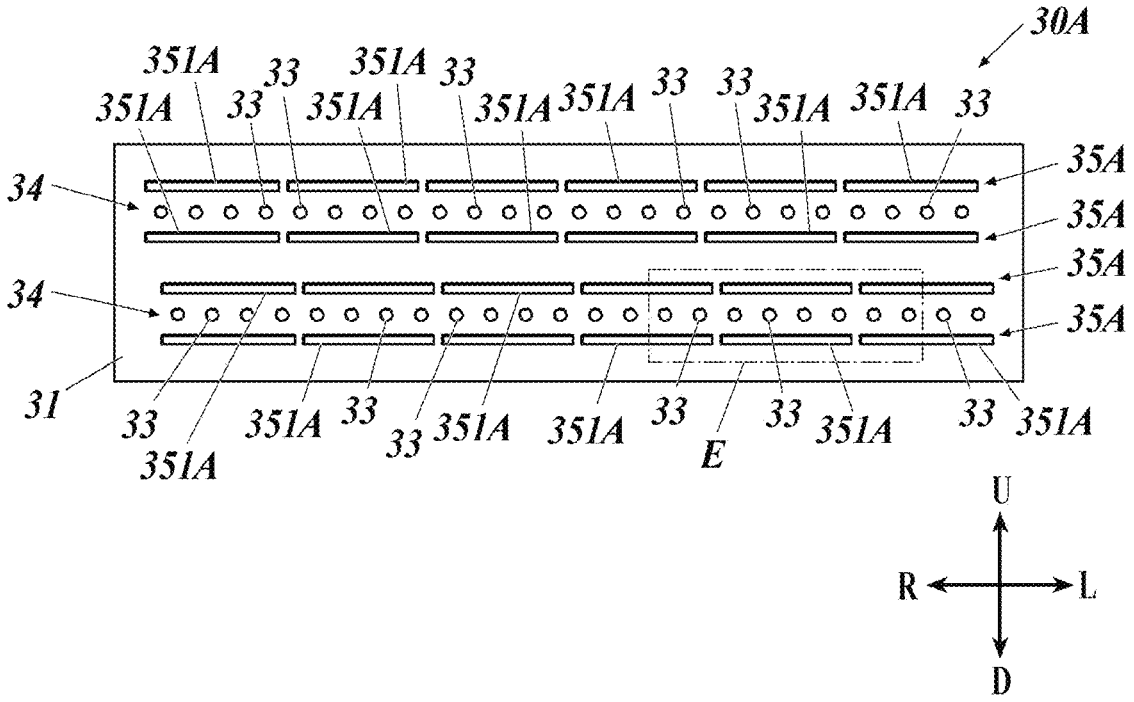
FIG. 27A is a plan view of a nozzle plate as another example (1) of forming grooves in a nozzle plate.
Figure 27B:
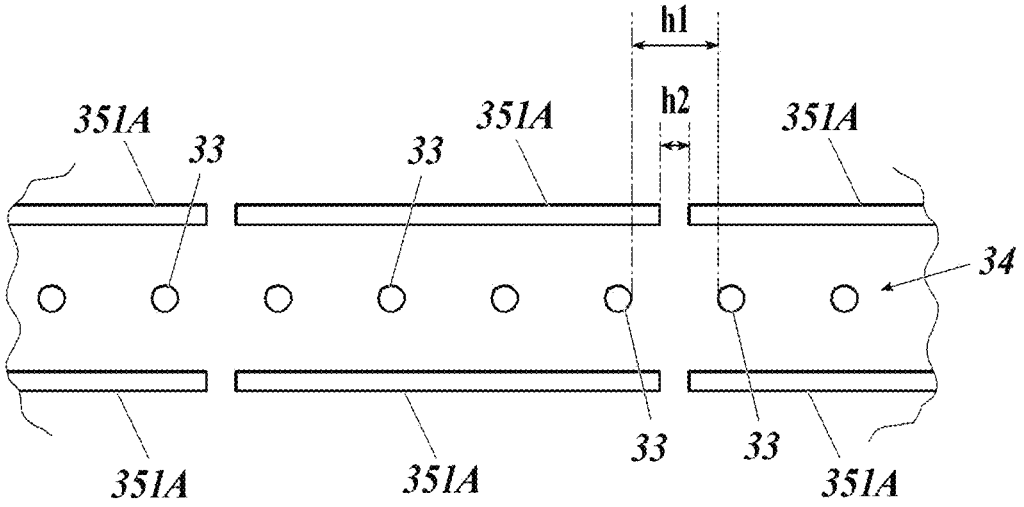
FIG. 27B is an enlarged view of a region E in FIG. 27A.

FIG. 27A is a plan view of a nozzle plate 30A as another example (1) of forming grooves for the nozzle plate. FIG. 27B is an enlarged view of a region E of FIG. 27A.

A plurality of grooves 35A of a nozzle plate 30A are formed in the same range and at the same position as the grooves 35 described above, but each groove 35A differs in being made up of a plurality of small grooves 351A along the same straight line which is parallel to the nozzle rows 34. In other words, although a groove 35 described above is made up of a single long groove that is longer than a nozzle row 34, a groove 35A is made up of a groove 35 that has been divided into a plurality of small grooves.

Accordingly, there is a gap region between adjacent small grooves 351A, as illustrated in FIG. 27B. Each small groove 351A is formed so that an interval h2 in the left/right direction of the gap region is narrower than an interval h1 of a gap region between adjacent nozzles 33.

Furthermore, each small groove 351A is formed with an arrangement in relation to the left/right direction such that the gap regions between adjacent small grooves 351A each does not overlap with any nozzle 33.

By this, in a case where the groove 35A is made up of a plurality of small grooves 351A, although it is not possible to accept adhesive in the gaps between small grooves 351A, because the gaps between small grooves 351A and the arrangements in relation to the left/right direction of the nozzles 33 do not overlap, the influence of the gaps is suppressed to a minimum, and it is possible to effectively suppress flow of adhesive into any nozzle 33.

When the grooves 35A are made up from a plurality of small grooves 351A, it is also possible to reduce an influence of residual stress after processing and forming. Accordingly, it is desirable to form the grooves 35A by wet etching, but even if, hypothetically, they are formed by laser machining or press working, it is possible to suppress an influence of warping, and efficiently manufacture them.

It is possible to manufacture the nozzle plate 30A by the same steps as for the nozzle plate 30 described above. In the groove formation step, it is possible to form the grooves 35A by laser machining or press working instead of by wet etching, as described above.

Another Example (2) of Forming Grooves in Nozzle Plate

Figure 28:
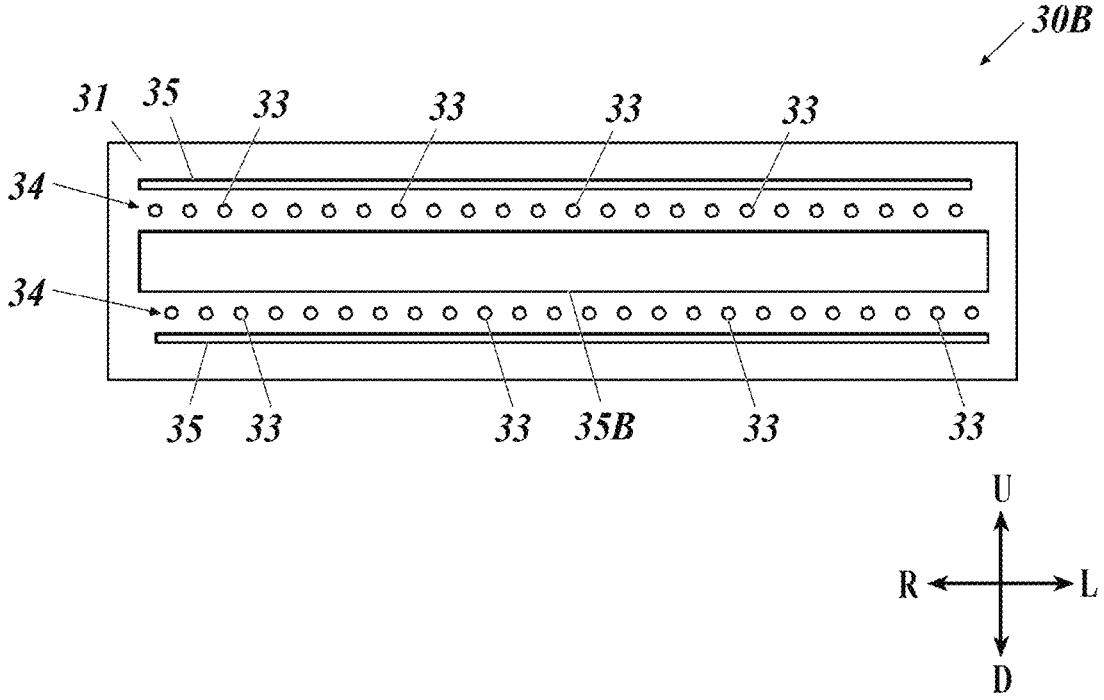
FIG. 28 is a plan view of a nozzle plate as another example (2) of forming grooves in a nozzle plate.

FIG. 28 is a plan view of a nozzle plate 30B as another example (2) of forming grooves in a nozzle plate.

As with the nozzle plate 30 described earlier, when forming grooves 35 on both sides of a nozzle row 34 to sandwich the nozzle row 34, two grooves 35 are formed between one nozzle row 34 and another nozzle row 34, but the two grooves 35 between the one nozzle row 34 and the other nozzle row 34 may be combined into one groove.

The nozzle plate 30B has a form in which grooves between one nozzle row 34 and another nozzle row 34 are combined into one groove. In such a case, it is desirable for a groove 35B formed between the one nozzle row 34 and the other nozzle row 34 to have a wider width than the groove 35 previously described, to ensure the capacity of two grooves 35 for adhesive.

If an offset of ½ the nozzle pitch is formed between the nozzles 33 of one nozzle row 34 and the nozzles 33 of the other nozzle row 34, it is desirable for the groove 35B to have a length and arrangement such that the entire length of both nozzle rows 34 is included within the groove 35B in relation to the left/right direction.

It is possible to manufacture the nozzle plate 30B by the same steps as for the nozzle plate 30 described above.

With this structure of the nozzle plate 30B, it becomes possible to reduce the number of grooves, and it becomes possible to make manufacture of the nozzle plate 30B easier and more efficient.

Another Example (3) of Forming Grooves in the Nozzle Plate

Figure 29:
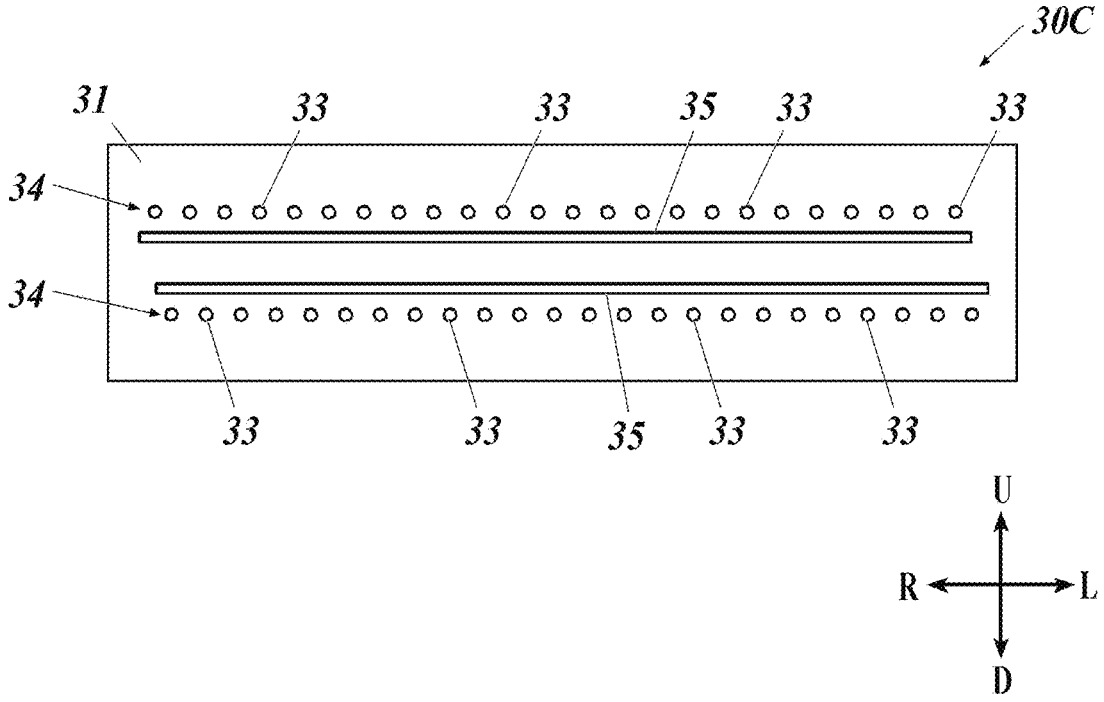
FIG. 29 is a plan view of a nozzle plate as another example (3) of forming grooves in a nozzle plate.

FIG. 29 is a plan view of a nozzle plate 30C as another example (3) of forming grooves in a nozzle plate.

In the nozzle plate 30 described above, grooves 35 are formed on both sides of a nozzle plate 34 to sandwich the nozzle rows 34, but it is possible to omit grooves 35 that are on sides outward from all nozzle rows 34 (the topmost groove 35 and the bottommost groove 35 in FIG. 3) in the direction in which the nozzle rows 34 line up (up/down direction).

In this way, in the case of the nozzle plate 30C which omits formation of grooves 35 on sides outward from all the nozzle rows 34, because the number of grooves 35 is reduced, the capacity for adhesive is reduced, and an effect of suppressing flow of adhesive into the nozzles 33 is reduced.

However, because it is possible to, in regions where the grooves 35 on sides outward from all nozzle rows 34 were arranged, squeeze out excess adhesive from outer edges of the nozzle plate 30C (outward from the top edge and the bottom edge), an amount of adhesive flowing into a region between one nozzle row 34 and the other nozzle row 34 will not be large. Accordingly, if grooves 35 are provided in the region between one nozzle row 34 and another nozzle row 34, it is possible to suppress flow of adhesive into the nozzles 33, and it is possible to reduce the occurrence of discharge failure due to blockage of the nozzles 33.

It is possible to manufacture the nozzle plate 30C by the same steps as for the nozzle plate 30 described above.

Relationship Between Thickness of Nozzle Plate and Discharge Performance

Figures 30, 31:
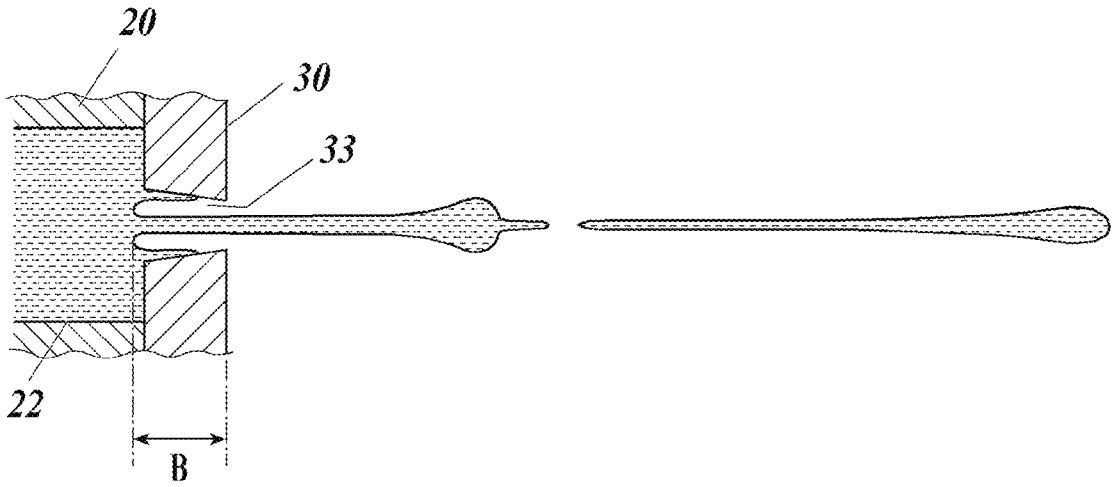
FIG. 30 is a view that illustrates simulation results for obtaining a relationship between the thickness of a nozzle plate and the formation of a meniscus which influences discharge performance.
FIG. 31 is a view that illustrates a length from a surface on the discharge side of the nozzle plate to a retreating portion of the meniscus.

FIG. 30 lists simulation results for obtaining a relationship between the thickness of a nozzle plate 30 and the formation of a meniscus which influences discharge performance.

When discharging liquid from a nozzle 33, a meniscus is formed at the nozzle 33. The greater that an amount of retreat from a liquid surface in accordance with this meniscus, the more likely it is for the meniscus to engulf a bubble at a time of discharge and break, and the greater the probability of a discharge failure occurring.

The amount of retreat from the liquid surface in accordance with the meniscus is, as illustrated by FIG. 31, an amount resulting from subtracting the thickness of the nozzle plate 30 from a length B that is from the surface of the nozzle plate 30 on the discharge side to a retreating portion of the meniscus.

Setting the thickness of the nozzle plate 30 to 20, 30, 40, 50, and 60 μm, and evaluating an ease of assembly and the amount of retreat of the meniscus, when the thickness of the nozzle plate 30 becomes as thin as 20 μm, the amount of retreat of the meniscus from the liquid surface becomes large, and discharge ceases to be performed satisfactorily.

When the thickness of the nozzle plate 30 becomes as thick as 60 μm, because the elastic force of the nozzle plate 30 becomes stronger than the adhesive force between the head chip 20 and the nozzle plate 30 due to the adhesive, if warping occurs in the nozzle plate 30 when pasting the nozzle plate 30 onto the head chip 20 by the adhesive, the nozzle plate 30 may peel away, it becomes more likely for a leak to occur due to shearing forces in accordance with differences in linear expansion when baking to harden the adhesive, and ease of assembly worsens. Due to this, discharge ceases to be satisfactorily performed.

Accordingly, a result that discharge is satisfactorily performed with the thickness of the nozzle plate 30 in a range to 30 to 50 μm is obtained.

Other Points

Cases where there are two nozzle rows in the nozzle plates 30, 30A, 30B, and 30C were exemplified, but the number of nozzle rows 34 is not limited to two, and may be one or three or more. In such a case, although it is desirable to provide grooves 35 on both sides for each nozzle row 34, two grooves 35 between adjacent nozzle rows 34 may be combined into one as with the groove 35B described above.

With the nozzle plates 30, 30A, 30B, and 30C described above, description was given for examples in which the grooves 35, 35A, and 35B are formed so as to not penetrate through to the second surface 32, but if it is possible to ensure the strength necessary for the nozzle plates 30, 30A, 30B, and 30C in accordance with material, structural design, or the like, the grooves 35, 35A, and 35B may be formed to penetrate through to the second surface 32.

In addition, it is of course also possible to appropriately change a specific detailed structure or the like.

INDUSTRIAL APPLICABILITY

The method of manufacturing a nozzle plate, and the inkjet head according to the present invention have industrial applicability in the field of making a nozzle plate from metal.

REFERENCE SIGNS LIST

10 inkjet head
20 head chip
21 adhesion surface
22 channel
30, 30A, 30B, 30C, nozzle plate
31 first surface
32 second surface
33 nozzle
34 nozzle row
35, 35A, 35B groove
36 division
37 bridge
38 water repellent film
351A small groove
h1, h2 interval
L reference symbol
P plate-like member

The invention claimed is:

1. A method of manufacturing a metal nozzle plate, in which is formed a nozzle for discharging a liquid and that is to be bonded with adhesive to a head chip provided with an actuator for discharging the liquid, the method comprising:
forming the nozzle in a metal plate-like member;
forming a groove in the metal plate-like member; and
performing exterior processing with respect to the nozzle plate,
wherein
in the exterior processing, the nozzle plate is separated from the metal plate-like member by dividing along the exterior of the nozzle plate, and
the method further comprises forming a water repellent film on the metal plate-like member after the groove is formed and before the exterior processing.

2. The method according to claim 1, wherein
in the forming of the nozzle, one or a plurality of nozzle row in which a plurality of the nozzle are lined up in a straight line in a certain direction and at a certain interval is formed, and
in the forming of the groove, the groove is formed parallel to the certain direction.

3. The method according to claim 2, wherein
in the forming of the groove, the groove is formed by a plurality of small grooves lined up on the same straight line parallel to the certain direction, and
an interval of a gap region between adjacent small grooves is smaller than an interval of a gap region between adjacent nozzles.

4. The method according to claim 3, wherein
in the forming of the groove, each of the small grooves is formed in relation to the certain direction such that the gap region between adjacent small grooves does not overlap any nozzle of a nozzle row adjacent to the groove.

5. The method according to claim 2, wherein
in the forming of the groove, the groove is formed to be longer than the nozzle row and so that the nozzle row is within the groove in the certain direction.

6. The method according to claim 2, wherein
in the forming of the groove, the groove is formed at positions on both sides of the nozzle row to sandwich the nozzle row.

7. The method according to claim 1, wherein
the groove is formed by wet etching.

8. The method according to claim 1, wherein, in the exterior processing, wet etching is performed on the metal plate-like member along the exterior of the nozzle plate, from a surface in which the groove was formed.

9. The method according to claim 1, further comprising polishing a surface in which the groove is to be formed before the groove is formed.

10. The method according to claim 1, wherein in the forming of the nozzle, the nozzle is formed by press working and polishing, or by laser machining.

11. A method of manufacturing a metal nozzle plate, in which is formed a nozzle for discharging a liquid and that is to be bonded with adhesive to a head chip provided with an actuator for the liquid, the method comprising:
forming the nozzle in a metal plate-like member;
forming a groove in the metal plate-like member; and
performing exterior processing with respect to the nozzle plate, wherein
in the exterior processing, a division that leaves a bridge is formed in the metal plate-like member along the exterior of the nozzle plate, and
the method further comprises:
forming a water repellent film on the metal plate-like member after the exterior processing; and
cutting the bridge to separate the nozzle plate after the water repellent film is formed.

12. An inkjet head, comprising:
a head chip provided with an actuator for discharging a liquid; and
a metal nozzle plate that is bonded with adhesive to the head chip, a nozzle for discharging the liquid being formed in the nozzle plate, wherein
one or a plurality of nozzle row in which a plurality of the nozzle are lined up in a straight line in a certain direction and at a certain interval is formed in the nozzle plate,
a groove is formed parallel to the certain direction on a first surface of the nozzle plate, the first surface facing the head chip, and
a water repellent film is coated on a second surface of the nozzle plate, the second surface being on an opposite side from the head chip,
wherein the nozzle plate is formed in a metal plate-like member, the nozzle plate is separated from the metal plate-like member by dividing along the exterior of the nozzle plate, and the water repellent film is formed on the metal plate-like member after the groove is formed and before the separating.

13. The inkjet head according to claim 12, wherein
the groove comprises a plurality of small grooves lined up on the same straight line parallel to the certain direction, and
the groove is formed so that an interval of a gap region between adjacent small grooves is smaller than an interval of a gap region between adjacent nozzles.

14. The inkjet head according to claim 13, wherein each of the small grooves is formed in relation to the certain direction such that the gap region between adjacent small grooves does not overlap any nozzle of a nozzle row adjacent to the groove.

15. The inkjet head according to claim 12, wherein the groove is formed to be longer than the nozzle row and so that the nozzle row is within the groove in the certain direction.

16. The inkjet head according to claim 12, wherein the groove is formed on both sides of the nozzle row to sandwich the nozzle row.

17. The inkjet head according to claim 12, wherein some or all of a perimeter end surface formed at a perimeter of the nozzle plate is such that an edge of the perimeter end surface on a side of the first surface is at an obtuse angle with respect to the first surface.

18. The inkjet head according to claim 12, wherein the nozzle plate is made of stainless steel, and the thickness of the nozzle plate is from 30 μm to 50 μm.

19. The inkjet head according to claim 18, wherein a depth of the groove is from 5 μm to 20 μm.

20. A method of manufacturing a metal nozzle plate, in which is formed a nozzle for discharging a liquid and that is to be bonded with adhesive to a head chip provided with an actuator for discharging the liquid, the method comprising:

forming the nozzle in a metal plate-like member;

forming a groove in the metal plate-like member; and performing exterior processing with respect to the nozzle plate, wherein, in the exterior processing, wet etching is performed on the metal plate-like member along the exterior of the nozzle plate, from a surface in which the groove was formed.

21. An inkjet head, comprising:

a head chip provided with an actuator for discharging a liquid; and a metal nozzle plate that is bonded with adhesive to the head chip, a nozzle for discharging the liquid being formed in the nozzle plate, wherein one or a plurality of nozzle row in which a plurality of the nozzle are lined up in a straight line in a certain direction and at a certain interval is formed in the nozzle plate, a groove is formed parallel to the certain direction on a first surface of the nozzle plate, the first surface facing the head chip, and a water repellent film is coated on a second surface of the nozzle plate, the second surface being on an opposite side from the head chip, wherein some or all of a perimeter end surface formed at a perimeter of the nozzle plate is such that an edge of the perimeter end surface on a side of the first surface is at an obtuse angle with respect to the first surface.

* * * * *